US008041241B2

(12) United States Patent
Kawasaki et al.

(10) Patent No.: US 8,041,241 B2
(45) **Date of Patent: *Oct. 18, 2011**

(54) IMAGE FORMING APPARATUS AND IMAGE FORMING METHOD WHICH CONTROLS THE EXPOSING OF AN IMAGE CARRIER TO CHANGE THE EXPOSURE TIME PERIOD IN THE MAIN SCANNING DIRECTION

(75) Inventors: Akihiro Kawasaki, Hyogo (JP); Yoshiko Ogawa, Osaka (JP); Rumi Konishi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 910 days.

This patent is subject to a terminal disclaimer.

(21) Appl. No.: 12/017,942

(22) Filed: Jan. 22, 2008

(65) Prior Publication Data

US 2008/0199792 A1 Aug. 21, 2008

(30) Foreign Application Priority Data

Feb. 15, 2007 (JP) ..... 2007-034579

(51) Int. Cl.
*G03G 15/043* (2006.01)

(52) U.S. Cl. ..... 399/51; 399/53

(58) Field of Classification Search ..... 399/51, 399/53; 347/240, 251–254
See application file for complete search history.

(56) References Cited

U.S. PATENT DOCUMENTS

| | | | | |
|---|---|---|---|---|
| 6,433,803 | B2 * | 8/2002 | Mutou et al. | 347/252 |
| 7,791,635 | B2 * | 9/2010 | Ogawa et al. | 347/252 |
| 2006/0280529 | A1 | 12/2006 | Nakagawa et al. | |

FOREIGN PATENT DOCUMENTS

| | | | |
|---|---|---|---|
| JP | 4-276778 | | 10/1992 |
| JP | 2002-292929 | | 10/2002 |
| JP | 2003098773 | A * | 4/2003 |

* cited by examiner

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

In a disclosed image forming apparatus, a developing bias applied to a developer carrier or exposure energy with which an image carrier is exposed is adjusted such that an isolated one-dot image on the image carrier has a predetermined image density. When the image carrier is exposed to form dot images continuously arranged in a main scanning direction, the exposure time period for each dot image is shorter than that when the image carrier is exposed to form the isolated one-dot image.

17 Claims, 16 Drawing Sheets

IMAGE FORMING APPARATUS AND IMAGE FORMING METHOD WHICH CONTROLS THE EXPOSING OF AN IMAGE CARRIER TO CHANGE THE EXPOSURE TIME PERIOD IN THE MAIN SCANNING DIRECTION

BACKGROUND OF THE INVENTION

1. Field of the Invention

The present invention relates to an image forming apparatus such as a printer, a facsimile machine, and a copier, and an image forming method.

2. Description of the Related Art

Image forming apparatuses such as low-cost laser-beam printers employ a contact-type developing method performed with the use of a non-magnetic one-component developer. With this method, the image forming apparatus can have a simple structure and power source costs can be reduced. In the contact-type developing method performed with the use of a non-magnetic one-component developer, no gap is formed at the developing nip between a photoconductor, which acts as a latent image carrier, and toner. Therefore, in this method, a wraparound electric field is not generated, unlike the case of using a two-component developer (hereinafter, "two-component developing") or using a one-component developer in a non-contact-type developing method (hereinafter, "one-component non-contact developing"). Accordingly, in the contact-type developing method performed with the use of a one-component developer, an edge effect does not occur as much as in the case of two-component developing or one-component non-contact developing; hence, the latent image can be precisely developed.

When light is written onto a photoconductor to form an isolated one-dot image, the latent image electric potential distribution is substantially a Gaussian distribution (normal distribution). In the case of two-component developing or one-component non-contact developing, an edge effect occurs, and therefore an isolated one-dot image can be reproduced with a weak laser beam. However, in the case of a contact-type developing method performed with the use of a non-magnetic one-component developer, a wraparound electric field is not generated, and therefore an isolated one-dot image cannot be properly reproduced with a laser beam having the same intensity as that used in two-component developing or one-component non-contact developing.

As a result, as indicated by a line joining ◇ marks in the graph shown in FIG. 11, the low density portions in area gradation including isolated one-dot images will have a lower density than the ideal density.

In order to enhance the reproducibility of isolated one-dot images, various measures are taken, such as intensifying the laser beam or adjusting the developing bias (see, for example, Patent Document 1).

Patent Document 1: Japanese Laid-Open Patent Application No. 2002-292929

If the laser beam is intensified in an attempt to enhance the reproducibility of isolated one-dot images, the following problem arises. That is, gradation loss will occur (portions that are supposed to be blank will be developed) in high density portions of the area gradation, as indicated by a line joining ● marks in the graph shown in FIG. 11.

Area gradation is described with reference to FIG. 12. In a matrix of 4 dots×4 dots=16 dots, a first gradation level is expressed by forming an image at one portion (one dot) of the 16 dot matrix. As the gradation level increases, more portions of the 16 dot matrix will include dot images. At a sixteenth gradation level, the entire 16 dot matrix will be filled with dot images. In FIG. 12, the matrix includes a region corresponding to dot images (the black portions in the figure) and a region corresponding to non-image dots (the white portions in the figure). However, in reality, an error diffusion method is employed to disperse the image dots and the non-image dots.

In FIG. 13, (a) illustrates an example of potentials on a photoconductor surface at a low density portion in the area gradation and corresponding dot images. In FIG. 13, (b) illustrates an example of potentials on a photoconductor surface at a high density portion in the area gradation and corresponding dot images.

As shown in (a) of FIG. 13, at a low density portion in the area gradation, non-image dots are continuously arranged, and each dot image is isolated. In such a case, by intensifying the laser beam, the reproducibility of one-dot images can be enhanced so that favorable gradation properties are attained.

As shown in (b) of FIG. 13, at a high density portion in the area gradation, dot images are continuously arranged, and each non-image dot is isolated. The laser beam is intensified in an attempt to enhance reproducibility of isolated one-dot images. Thus, if each dot image on either side of the isolated non-image dot is used for exposing, the potential of the isolated non-image dot will be attenuated. As a result, each of the isolated non-image dots will have a potential (potential of exposed portions) that is lower than the developing bias, and the isolated non-image dots will be developed (i.e., portions corresponding to isolated non-image dots, which are supposed to be blank, will appear as dot images in the developed image). In this manner, gradation loss will occur in high density portions of the area gradation.

Another method of enhancing reproducibility of isolated one-dot images is to adjust the developing bias.

FIG. 14 illustrates an example in which the developing bias is adjusted to enhance the reproducibility of isolated one-dot images.

As shown in (a) of FIG. 14, in order to enhance the reproducibility of isolated one-dot images by adjusting the developing bias, the latent image region is developed with the use of the developing bias (2), which is closer to the potential of unexposed portions of the photoconductor than the conventional developing bias (developing bias (1)). Accordingly, the developed latent image region can be made to have a width of one dot, thereby enhancing the reproducibility of isolated one-dot images.

Furthermore, if the developing bias is adjusted to enhance the reproducibility of isolated one-dot images, the width of a latent image potential distribution on the surface of a photoconductor will be narrower compared to the case of intensifying laser beams. Thus, as shown in (b) of FIG. 14, at each isolated non-image dot, the latent image potentials that are adjacent to the isolated non-image dot (on opposite sides thereof) in the main scanning direction are not overlapping each other. Therefore, the potential at the non-image dot will not become as low as the potential of the exposed portions. As a result, gradation loss will not occur in high density portions of the area gradation.

However, even by adjusting the developing bias, the potential on the photoconductor surface significantly attenuates at portions where dot images are continuously arranged, although not as much as that in the case of intensifying the laser beam. In the case of adjusting the developing bias to enhance the reproducibility of isolated one-dot images, the developing bias is made to be closer to the potential of unexposed portions of the photoconductor. For this reason, the difference between the potential of exposed portions of the photoconductor surface and the developing bias (developing potential) becomes large. As a result, at portions where dot images are continuously arranged, the toner density becomes dark. Thus, there has been a problem in that the image density becomes dark at mid-density portions to high density portions in the area gradation where dot images are continuously arranged.

SUMMARY OF THE INVENTION

The present invention provides an image forming apparatus and an image forming method in which one or more of the above-described disadvantages are eliminated.

A preferred embodiment of the present invention provides an image forming apparatus and an image forming method in which area gradation properties are enhanced in a contact-type developing method performed with the use of a non-magnetic one-component developer.

An embodiment of the present invention provides an image forming apparatus including an image carrier; an exposing unit configured to expose a surface of the image carrier with exposure energy based on image data corresponding to dot images to form a latent image; and a developing unit configured to perform a developer contact developing method by applying a developing bias onto a developer carrier carrying a non-magnetic one-component developer and causing the non-magnetic one-component developer on the developer carrier to contact the image carrier, thereby developing the latent image on the image carrier into a toner image, wherein the toner image on the image carrier is transferred onto a recording material, either directly or via a surface of an intermediate transfer body; and the developing bias or the exposure energy is adjusted such that an isolated one-dot image has a predetermined image density, the image forming apparatus further including a control unit configured to control the exposing unit in such a manner that, when the image carrier is exposed to form the dot images continuously arranged in a main scanning direction, a width of a latent image potential distribution in the main scanning direction corresponding to each of the dot images on the image carrier is shorter than that when the image carrier is exposed to form the isolated one-dot image.

An embodiment of the present invention provides an image forming method including the steps of forming a latent image on a surface of an image carrier by exposing the surface of the image carrier based on input image data corresponding to dot images; and developing the latent image on the image carrier by performing a developer contact developing method with the use of a non-magnetic one-component developer, wherein when the image carrier is exposed to form the dot images continuously arranged in a main scanning direction, a width of a latent image potential distribution in the main scanning direction corresponding to each of the dot images on the image carrier is shorter than that when the image carrier is exposed to form the isolated one-dot image.

According to one embodiment of the present invention, an image forming apparatus and an image forming method are provided, in which area gradation properties are enhanced in a contact-type developing method performed with the use of a non-magnetic one-component developer.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

A description is given of a first embodiment of the present invention applied to a printer 100, which is an image forming apparatus.

Figure 1:
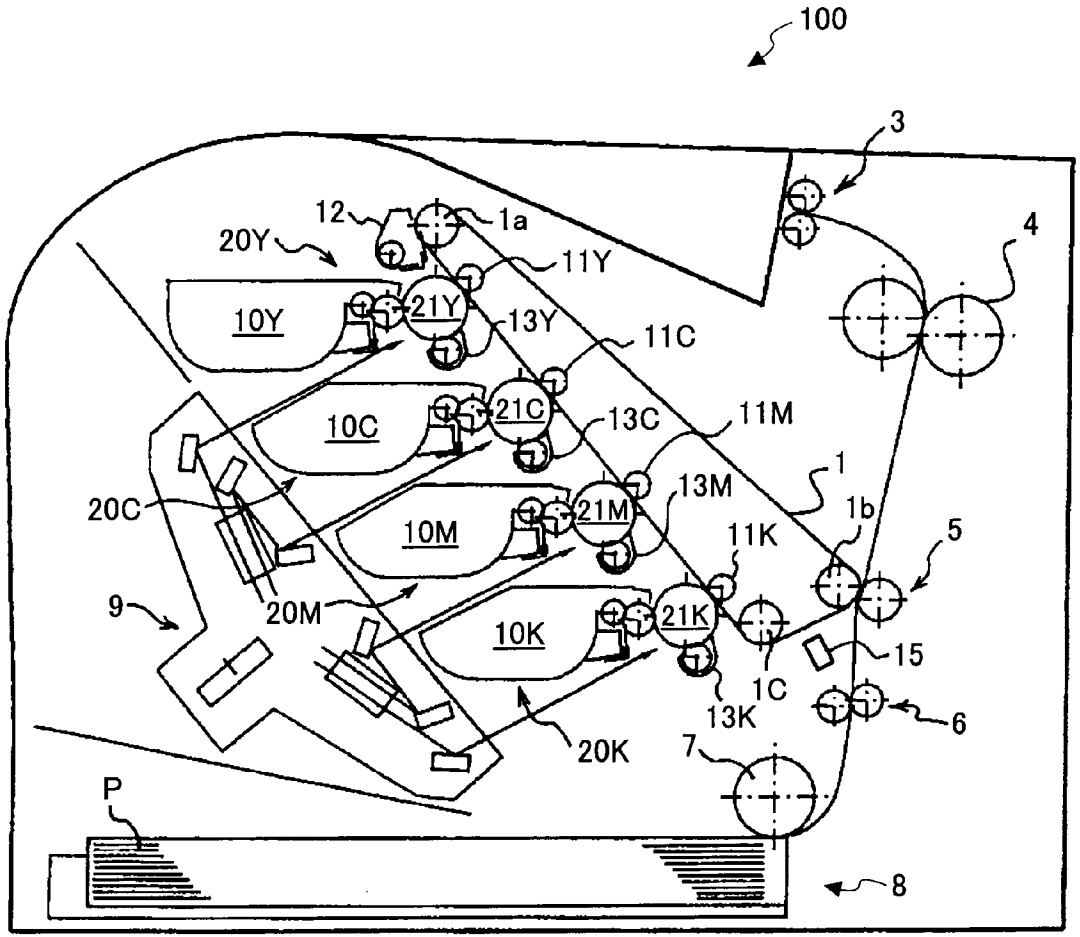
FIG. 1 is a schematic diagram of an image forming apparatus according to first and second embodiments of the present invention.

First, a description is given of the overall configuration and operation of the printer 100 according to the first embodiment of the present invention, with reference to FIG. 1.

The printer 100 includes a tandem image forming section with four image forming stations arranged in an oblique manner, corresponding to yellow, cyan, magenta, and black. In the tandem image forming section, toner image forming units 20Y, 20C, 20M, and 20K, which are individual toner image forming units, are arranged in the stated order starting from the top left when viewed in the figure. The letters Y, C, M, and K accompanying the reference numerals indicate that the corresponding members are for yellow, magenta, cyan, and black, respectively. In the tandem image forming section, the toner image forming units 20Y, 20C, 20M, and 20K include photoconductive drums 21Y, 21C, 21M, and 21K (photoconductors), respectively, which photoconductive drums are drum-type latent image carriers. The photoconductive drums 21Y, 21C, 21M, and 21K are surrounded by charging devices 13Y, 13C, 13M, and 13K, developing devices 10Y, 10C, 10M, and 10K, and photoconductor cleaning devices, respectively.

An optical writing unit 9 is provided as a latent image forming unit beneath the tandem image forming section. The optical writing unit 9 includes a light source, polygon mirrors, f-θ lenses, and reflection mirrors. The optical writing unit 9 is configured to scan the surface of each of the photoconductive drums 21 by irradiating laser beams based on image data.

An intermediate transfer belt 1 is provided along the obliquely-arranged tandem image forming section, which intermediate transfer belt 1 is an endless belt acting as an intermediate transfer body. The intermediate transfer belt 1 is wound around supporting rollers 1*a*, 1*b*, and 1*c*. Among these, the supporting roller 1*a* acts as a driving roller, and a not shown driving motor acting as a driving source is connected to the rotational shaft of the driving roller 1*a*. When this driving motor is driven, the intermediate transfer belt 1 rotates in a counterclockwise direction when viewed in the figure, and the supporting rollers 1*b* and 1*c* rotate following the rotation of the intermediate transfer belt 1. Primary transfer devices 11Y, 11C, 11M, and 11K are provided on the inside of the intermediate transfer belt 1 for transferring toner images formed on respective ones of the photoconductive drums 21Y, 21C, 21M, and 21K onto the intermediate transfer belt 1.

A reflective-type optical sensor 15, acting as a toner density detecting unit, is disposed at a position facing the surface of the intermediate transfer belt 1. The optical sensor 15 detects the optical reflectance of a toner image on the intermediate transfer belt 1. Based on the detection results, the amount of adhering toner is obtained, and image forming process conditions such as a charging bias, a developing bias, and an exposure amount are changed accordingly.

A secondary transfer roller 5 acting as a secondary transfer device is provided at a downstream position with respect to the primary transfer devices 11Y, 11C, 11M, and 11K, in the driving direction of the intermediate transfer belt 1. The supporting roller 1*b* is arranged opposite to the secondary transfer roller 5 across the intermediate transfer belt 1, which supporting roller 1*b* functions as a pressing member. The printer 100 includes a sheet feeding cassette 8, a sheet feeding roller 7, and a pair of registration rollers 6. The secondary transfer roller 5 transfers a toner image onto a transfer sheet P acting as a recording medium. At downstream positions of the secondary transfer roller 5, there are provided a fixing unit 4 for fixing the image on the transfer sheet P, and sheet eject rollers 3.

Next, operations of the printer 100 are described. In each image forming station, the corresponding photoconductive drum 21Y, 21C, 21M, or 21K is rotated. As the photoconductive drums 21Y, 21C, 21M, and 21K are rotated, first, the charging devices 13Y, 13C, 13M, and 13K uniformly charge the surfaces of the photoconductive drums 21Y, 21C, 21M, and 21K. Next, the optical writing unit 9 performs optical writing by irradiating laser beams corresponding to image data, thereby forming electrostatic latent images on the photoconductive drums 21Y, 21C, 21M, and 21K. Subsequently, toner is caused to adhere onto the electrostatic latent images by the developing devices 10Y, 10C, 10M, and 10K, and therefore the electrostatic latent images are turned into visible images. Accordingly, monochrome images of yellow, cyan, magenta, and black are formed on the photoconductive drums 21Y, 21C, 21M, and 21K, respectively. As the not-shown driving motor rotates the driving roller 1*a* so that the intermediate transfer belt 1 rotates, and the supporting rollers 1*b* and 1*c* and the secondary transfer roller 5 follows the rotation of the driving roller 1*a*, the visible images are sequentially transferred and superposed onto the intermediate transfer belt 1 by the primary transfer devices 11Y, 11C, 11M, and 11K. As a result, a composite color image is formed on the intermediate transfer belt 1. After the images have been transferred, photoconductor cleaning devices clean the surfaces of the photoconductive drums 21Y, 21C, 21M, and 21K by removing the remaining toner, to be prepared for the next image forming operation.

At the timing of forming an image, the leading edge of the transfer sheet P is delivered from the sheet feeding cassette 8 by the sheet feeding roller 7 and conveyed to the registration rollers 6, where the transfer sheet P temporarily stops. In synchronization with the timing of the image forming operation, the transfer sheet P is conveyed in between the secondary transfer roller 5 and the intermediate transfer belt 1. The transfer sheet P is sandwiched by the intermediate transfer belt 1 and the secondary transfer roller 5, thus forming a secondary transfer nip. At the secondary transfer roller 5, the toner image on the intermediate transfer belt 1 is transferred onto the transfer sheet P by a secondary transfer operation.

The transfer sheet P onto which the image has been transferred is sent to the fixing unit 4. The fixing unit 4 applies heat and pressure onto the transfer sheet P to fix the transferred image. Then, the transfer sheet P is ejected outside of the apparatus. After the image has been transferred from the transfer belt 1 onto the transfer sheet P, an intermediate transfer body cleaning device 12 removes remaining toner from the intermediate transfer belt 1, to be prepared for the next image forming operation performed by the tandem image forming section.

Each of the toner image forming units 20Y, 20C, 20M, and 20K corresponding to its respective color is a process cartridge that is detachably attached to the main unit. These process cartridges can be drawn out toward the front of the main body of the printer 100 along not shown guide rails fixed to the main body of the printer 100. By pressing these process cartridges into the back of the main body of the printer 100, the toner image forming units 20Y, 20C, 20M, and 20K are loaded into predetermined positions.

Figure 2:
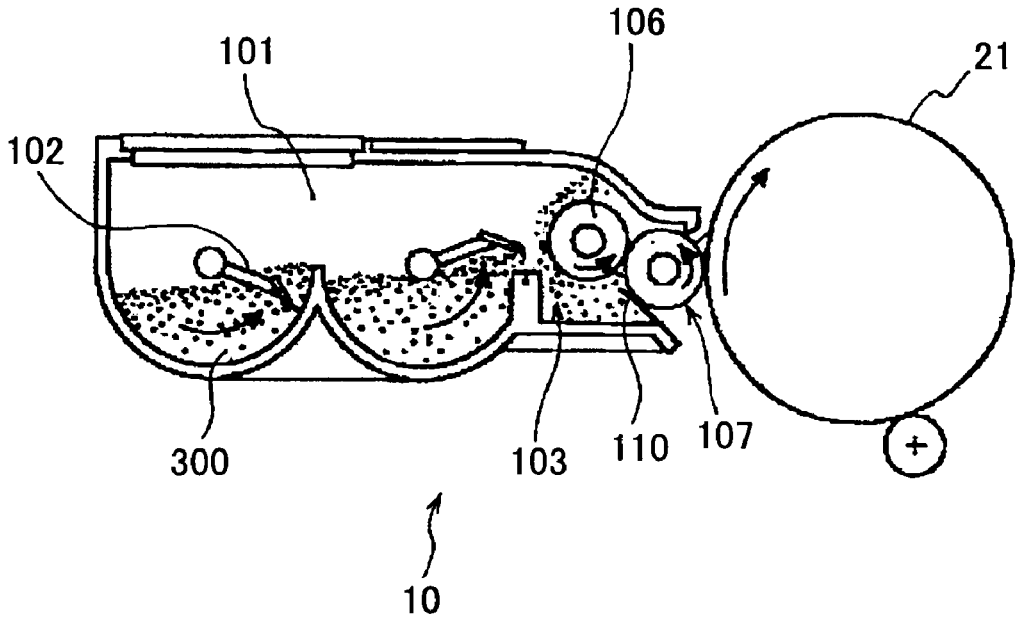
FIG. 2 is a schematic diagram of a developing device.

FIG. 2 is a schematic diagram of one of the developing devices 10. The developing device 10 is disposed in such a manner as to contact the photoconductive drum 21. The developing device 10 includes a developing roller 107 for providing toner onto the photoconductive drum 21 to develop an image, a supplying roller 106 disposed in such a manner as to abut the developing roller 107, a toner layer restricting member 110, and a toner storage chamber 101 for storing one-component toner 300.

The one-component toner 300 in the toner storage chamber 101 is moved by toner conveying members 102 to a toner supply chamber 103. The one-component toner 300 that has been moved to the toner supply chamber 103 adheres to the surface of the supplying roller 106, and is then applied to the surface of the developing roller 107. The amount of toner applied to the developing roller 107 is controlled by the toner layer restricting member 110 so that a thin toner layer is formed. As the developing roller 107 rotates, the toner, which has become a thin layer on the surface of the developing roller 107 due to control of the toner layer restricting member 110, is then conveyed to the developing nip that faces the photoconductive drum 21. According to a developing bias applied to the developing roller 107 and a latent image electric field created due to the electrostatic latent image on the photoconductive drum 21, the toner is then moved onto the surface of the photoconductive drum 21 to develop the latent image.

Figure 3:
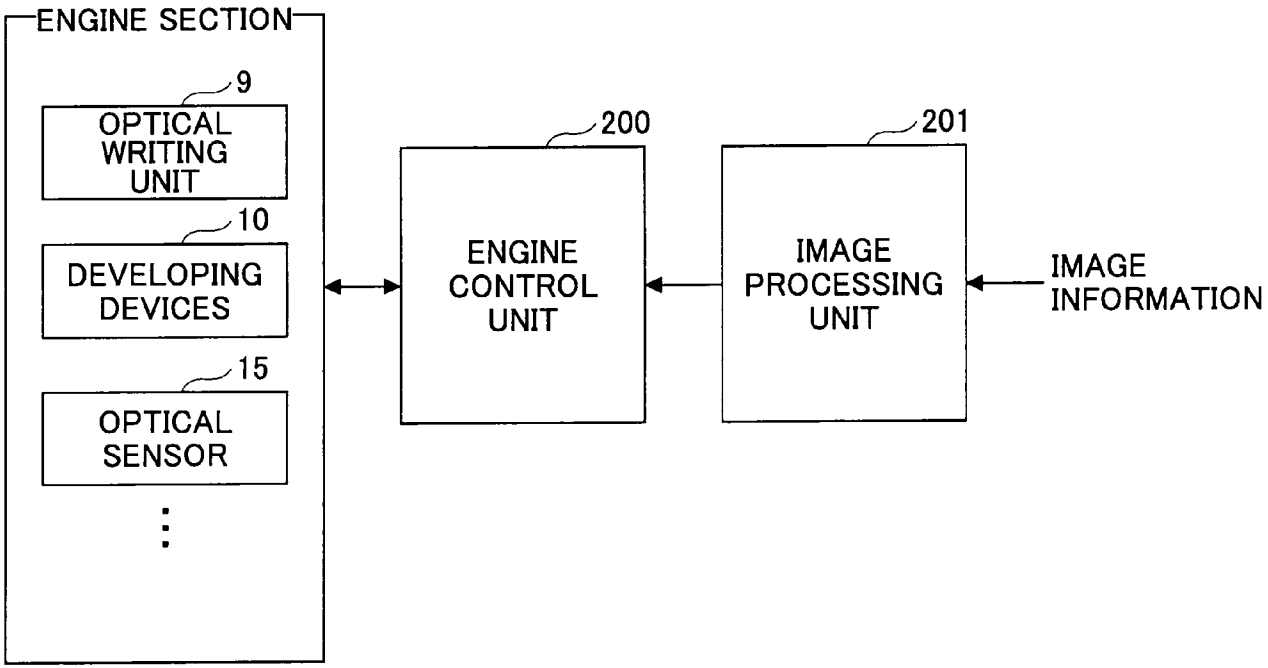
FIG. 3 is a functional block diagram of control units for controlling the image forming apparatus.

FIG. 3 is a block diagram of an electric connection of units in the image forming apparatus (printer 100). The image forming apparatus according to the first embodiment of the present invention includes an engine control unit 200 for controlling the driving operation of the photoconductors (photoconductive drums 21), the developing devices 10, the exposing device (optical writing unit 9), etc., and an image processing unit 201 for performing processes such as converting image information input from a personal computer (PC), etc., into digital signals.

The image information from the personal computer (PC) undergoes a predetermined digital signal process in the image processing unit 201, and image data based on the digital signals obtained by the process is then temporarily saved in an image storing unit. The image processing unit 201 performs digital signal processes such as a shading correction process, a filtering process, a γ correction process, and a graduation process, and image data to be output is then sent to the engine control unit 200.

The engine control unit 200, which has received the image data to be output sent from the image processing unit 201, drives/controls the sheet feeding device and the photoconductive drums 21, etc., by providing driving signals to driving motors, clutches, and solenoids that act as driving sources of movable portions thereof; the engine control unit 200 also drives/controls the charging devices 13 and the developing devices 10 by providing driving signals to high voltage power supply circuits thereof.

The engine control unit 200 receives the image data to be output (obtained as a result of the image process), and stores the image data in a line memory. The engine control unit 200 sends the data corresponding to dots from the line memory at a predetermined timing (dot clock) to the optical writing unit 9, in such a manner as to coincide with signals in synchronization with rotation of the polygon mirror (so-called synchronization signals). In the optical writing unit 9, this data is converted into signals to drive a laser diode (LD). The engine control unit 200 searches the data in the line memory for portions where dot image data is continuously arranged in the main scanning direction, and delays the timing of sending the dot image data that is continuously arranged in the main scanning direction to the optical writing unit 9. In this manner, the engine control unit 200 weakens the LD power (exposure energy) by reducing the exposing time or attenuating the control current for the laser diode.

The light from the laser diode forms parallel rays at a collimation lens, and an aperture cuts the parallel rays into a light beam having a desired beam diameter. The light beam that has passed through the aperture passes through a cylindrical lens, and is incident on the polygon mirror. The light beam reflected from the polygon mirror is condensed by a scanning lens (f-θ lens), turned around by a turn-around mirror, and focused on the surface of the photoconductive drum 21. Accordingly, an electrostatic latent image is formed on the surface of the photoconductive drum 21, and toner adheres to the electrostatic latent image so that a toner image is formed.

Next, a description is given of characteristics of the first embodiment.

Figure 4:
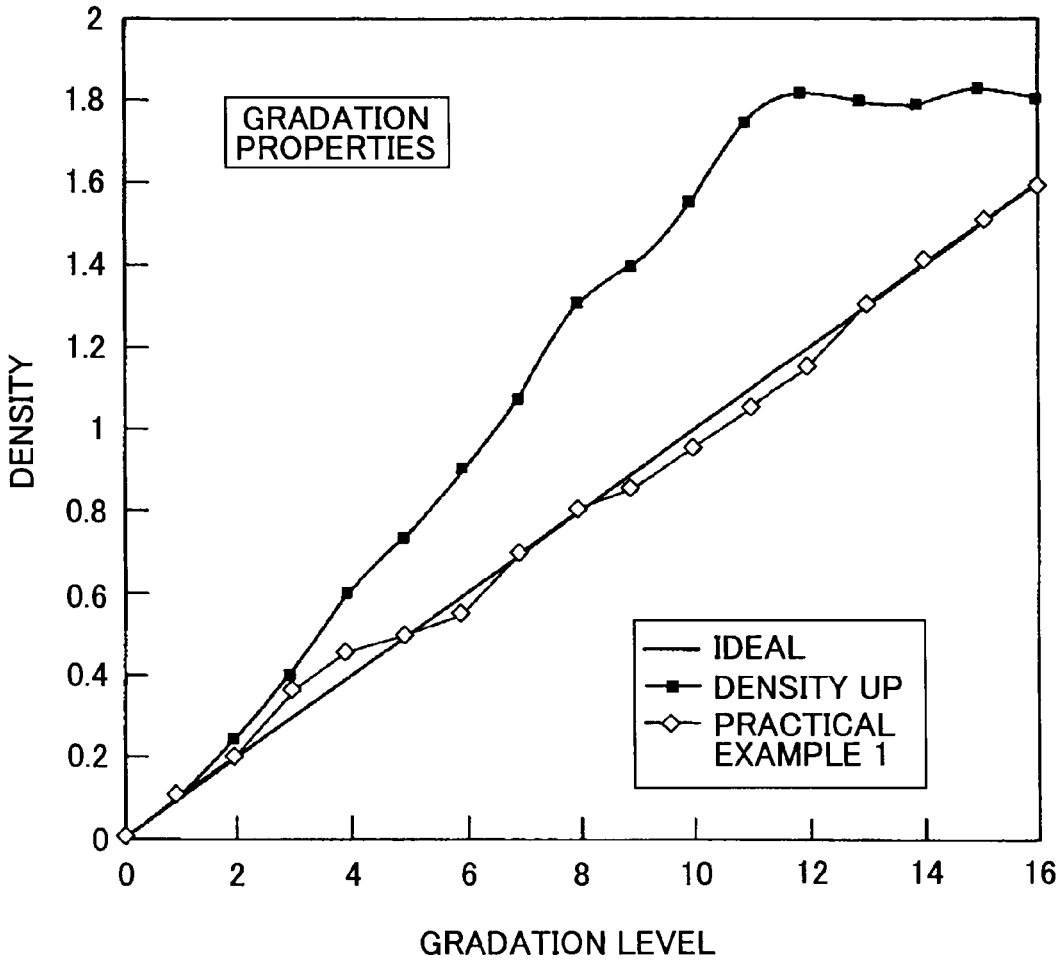
FIG. 4 is a graph indicating area gradation properties of practical example 1 and area gradation properties in a case where the developing bias is adjusted to attain favorable reproducibility of isolated one dot images.

In the first embodiment, in order to optimize the density of an isolated one-dot image, which has the lowest density in area gradation in the contact-type developing method performed with the use of a non-magnetic one-component developer, the following measure is taken. That is, the difference between the potential of exposed portions of the photoconductor and the developing bias (i.e., the developing potential) is made higher than that of the conventional case of using the two-component developer or the one-component non-contact developer. Specifically, as shown in FIG. 4, the developing bias is adjusted in such a manner that the density of an isolated one-dot image corresponds to an ideal value of 0.1. One method of making this adjustment is to form a detection pattern of a one-dot image in an image forming apparatus before shipment, and adjust the developing bias based on detection results. Accordingly, properties of the isolated one-dot image can be stabilized. However, the density at mid-density portions to high density portions in the area gradation will become higher than the ideal density indicated by the solid line. Furthermore, the density at the high density portions will become too high so that a regular optical sensor acting as a density detecting unit will not be able to detect the high density portions. As a result, it will not be possible to properly adjust the image quality, which adjustment is performed by forming patch images corresponding to low density gradation levels through high density gradation levels on the intermediate transfer belt 1, detecting these patch images with the optical sensor, and adjusting the charging bias and the developing bias.

Accordingly, in the first embodiment, in order to optimize the image densities at mid-density portions to high density portions in the area gradation and to attain preferable area gradation properties, the exposure time of dot images (the time of exposing a photoconductor to form a dot image) is changed according to the number of dot images continuously arranged in the main scanning direction.

Details are described below in practical examples 1 through 5.

Practical Example 1

First, a description is given of practical example 1.

Figure 5A:
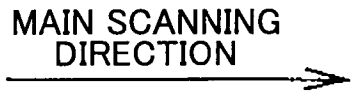
FIGS. 5A through 5C are diagrams for describing exposure timings in practical example 1.
Figure 5B:
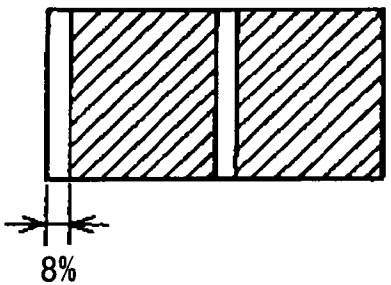
Figure 5C:
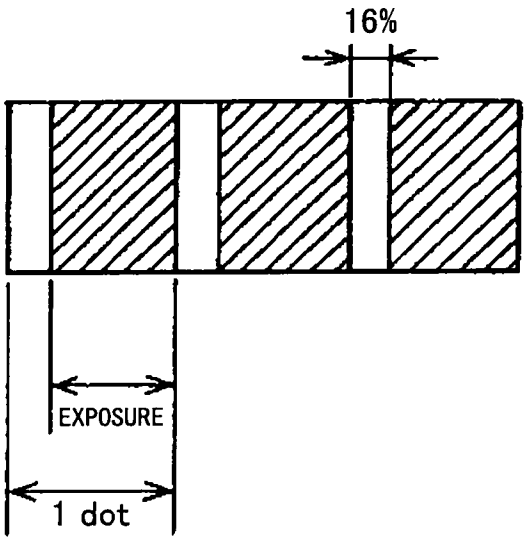

The engine control unit 200 searches the data corresponding to dots in the line memory for portions of continuously-arranged dots used for exposing the surface of the photoconductor by emitting light from a laser diode (hereinafter, "dot images"). If there is a dot image without any dot images on both sides thereof in the main scanning direction, i.e., if there is an isolated dot image, the photoconductor surface will be exposed to form the isolated dot image with full exposure as shown in FIG. 5A. If dot images are continuously arranged, the time of exposure for each dot image will be reduced compared to the case of an isolated dot image. As shown in FIG. 5B, if there are two dot images continuously arranged in the main scanning direction, the time of exposure for each dot image will be reduced by 8% compared to the case of an isolated dot image. As shown in FIG. 5C, if there are three dot images continuously arranged in the main scanning direction, the time of exposure for each dot image will be reduced by 16% compared to the case of an isolated dot image.

Figure 6:
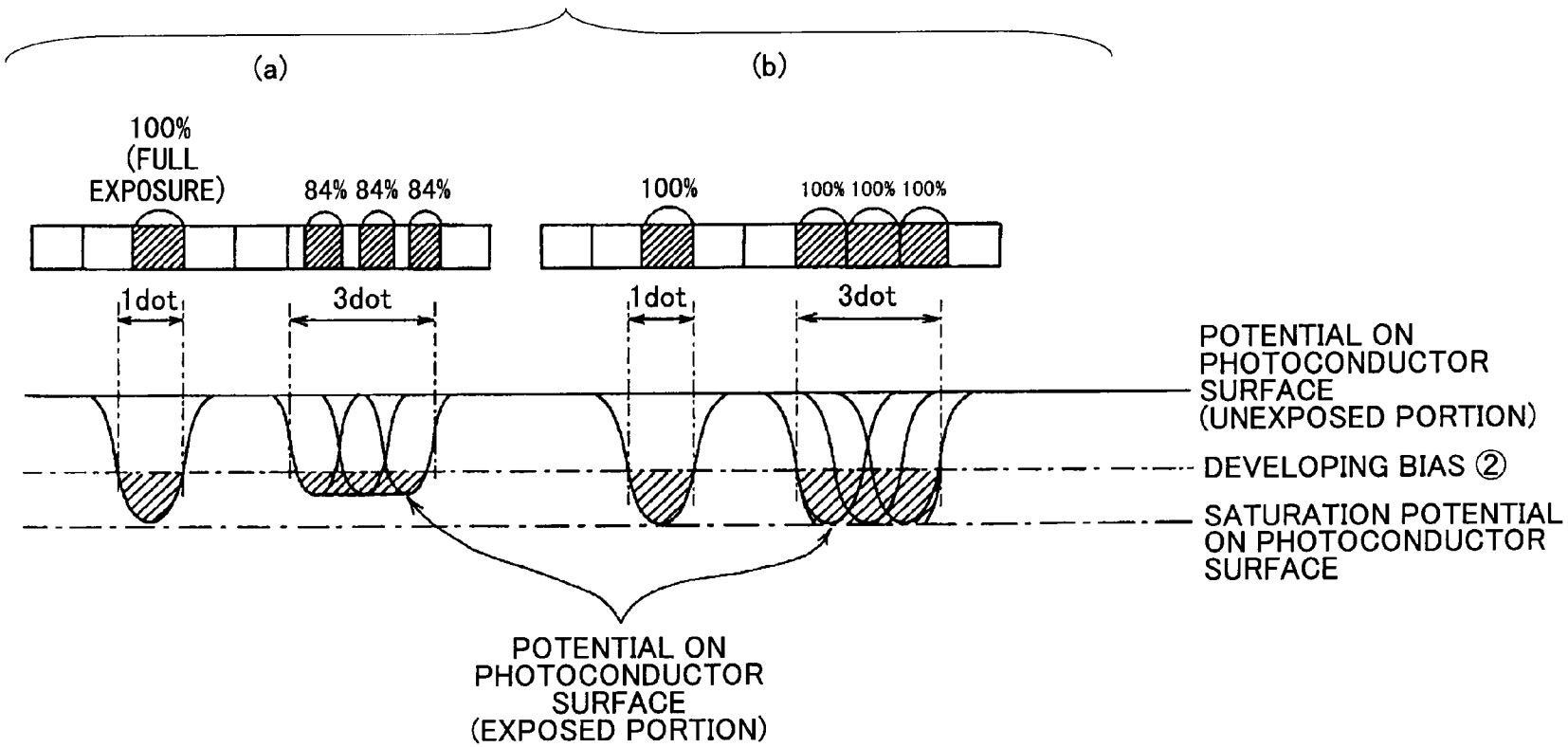
FIG. 6 illustrates potentials on a photoconductor surface, where (a) corresponds to practical example 1 and (b) corresponds to the conventional technology.

In FIG. 6, (a) illustrates the potential of exposed portions of the photoconductor according to the first embodiment of the present invention. In FIG. 6, (b) illustrates the potential of exposed portions of the photoconductor in a case where the exposure times are unchanged for dot images that are continuously arranged.

As shown in (b) of FIG. 6, in a case where the exposure times are unchanged for dot images that are continuously arranged, the developing potential (the difference between the developing bias and the potential of exposed portions of the photoconductor surface) is large where three dot images are continuously arranged. As a result, a large amount of toner will adhere to this portion.

As shown in (a) of FIG. 6, at portions where dot images are continuously arranged, the exposure time for each dot image is reduced compared to that for an isolated dot image. Therefore, the exposure amount is reduced, and the width and depth of each beam spot is reduced on the photoconductor surface. Consequently, the developing potential is reduced where three dot images are continuously arranged, and the amount of adhering toner can be maintained at an optimum level.

As a result, as indicated by a line joining ◇ marks in the graph shown in FIG. 4, in practical example 1, isolated one-dot images are favorably reproduced, and the density of a solid image corresponding to the sixteenth gradation level is substantially near the ideal value. Accordingly, it can be observed that the area gradation properties are significantly improved compared to the conventional technology.

Practical Example 2

A description is given of practical example 2.

In practical example 1, the lengths of exposure time were uniformly reduced according to the number of continuous dot images; however, with such a configuration, the densities are somewhat lower than the ideal values at the ninth through twelfth gradation levels, as shown in FIG. 4.

Accordingly, in practical example 2, in order to eliminate insufficient densities, the following findings have been obtained as a result of thorough research regarding the exposure time of continuous dot images. That is, when there are three or more continuous dot images in the main scanning direction, the exposure time of a dot image positioned in between dot images is to be shorter than those of the two dot images positioned at both ends.

Figure 7A:
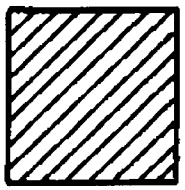
FIGS. 7A through 7C are diagrams for describing exposure timings in practical example 2.
Figure 7B:
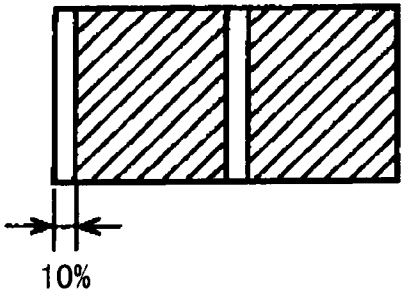
Figure 7C:
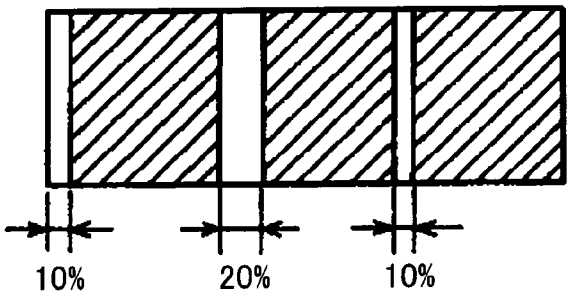

Specifically, as shown in FIG. 7B, when there are two continuous dot images, the printing time of each dot is reduced by 10% with respect to that of an isolated dot image. As shown in FIG. 7C, when there are three continuous dot images, the exposure time of a dot image positioned in between dot images is reduced by 20% with respect to that of an isolated dot image, while the exposure time of the dot images positioned at both ends is reduced by 10% with respect to that of an isolated dot image.

Figure 8:
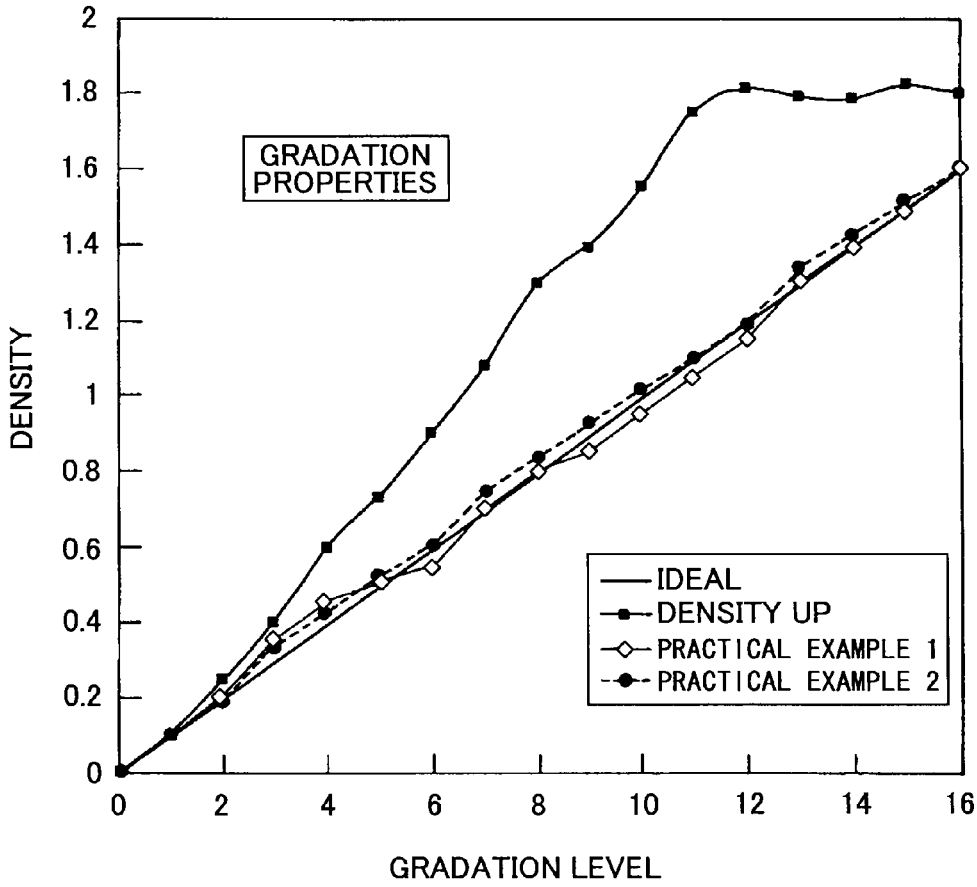
FIG. 8 is a graph indicating area gradation properties of practical example 1, area gradation properties of practical example 2, and area gradation properties in a case where the developing bias is adjusted to attain favorable reproducibility of isolated one dot images.

As shown in FIG. 8, in practical example 2, the insufficient densities at the ninth through twelfth gradation levels are improved.

Table 1 contains values of the linearity of the area gradation, which values were obtained by forming patch images corresponding to low density gradation levels through high density gradation levels on the intermediate transfer belt 1 under different conditions, and detecting them with an optical sensor. The linearity values were calculated with the use of the square of Pearson's product-moment correlation coefficient γ.

TABLE 1

| | LD light quantity UP | Bias UP | Practical Example 1 | Practical Example 2 | (Ideal) |
|---|---|---|---|---|---|
| $r^2$ | 0.892 | 0.933 | 0.964 | 0.986 | 1.000 |

As shown in Table 1, in the case where the reproducibility of an isolated one-dot image was improved only by increasing the LD light quantity ("LD light quantity UP" in Table 1), gradation loss occurred in high density portions; therefore the linearity was poor. Furthermore, in the case where the reproducibility of an isolated one-dot image was improved only by adjusting the developing bias ("Bias UP" in Table 1), the densities in the high density portions became excessively high so that the optical sensor was incapable of detecting the densities in the high density portions, and a constant value was obtained for the densities in the high density portions. For this reason, the linearity was poor. Meanwhile, the linearity was significantly improved in practical example 1. Moreover, the linearity was even more improved in practical example 2.

Practical Example 3

A description is given of practical example 3.

In practical examples 1 and 2, the exposure time was reduced by delaying the timing of starting exposure (timing of starting to emit light from a laser diode) for each dot. However, the dot images continuously arranged in the main scanning direction obtained by the exposure are not bilaterally-symmetric with respect to the center. As a result, positional shift and color shift may occur, which would lead to image noises.

Accordingly, in practical example 3, the exposure timing for each dot is controlled such that the dot images continuously arranged in the main scanning direction become bilaterally-symmetric with respect to the center.

Figure 9A:
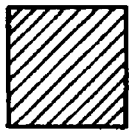
FIGS. 9A through 9C are diagrams for describing exposure timings in practical example 3.
Figure 9B:
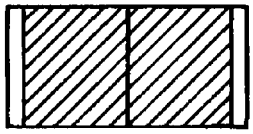

As shown in FIG. 9B, when there are two dot images continuously arranged in the main scanning direction, the timing of starting exposure (timing of starting to emit light from a laser diode) is delayed for the first dot image to be formed by exposure, which is on the left side when viewed in the figure. In practical example 1, the timing of starting exposure is delayed by 8%, whereas in practical example 2, the timing of starting exposure is delayed by 10%. Conversely, for the second dot image to be formed by exposure, which is on the right side when viewed in the figure, the timing of ending exposure is brought forward. The exposure timing is not limited to the above. For example, the timing of ending exposure can be brought forward for the first dot image, and the timing of starting exposure can be delayed for the second dot image. Furthermore, it is possible to adjust the timing of starting or ending exposure in such a manner that the beam spot on the photoconductor (exposure potential distribution) comes in the middle of the dot. In this case, in practical example 1, the timing of starting exposure is delayed by 4%, and the timing of ending exposure is brought up by 4%, so that the center of the dot coincides with the center of the beam spot.

Figure 9C:
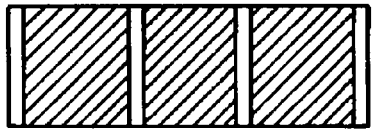

As shown in FIG. 9C, when there are three dot images continuously arranged in the main scanning direction, the timing of starting exposure (timing of starting to emit light from a laser diode) is delayed for the first dot image to be formed by exposure, which is on the left side when viewed in the figure. The timing of ending exposure is brought forward for the third dot image to be formed by exposure, which is on the right side when viewed in the figure. For the dot image positioned in between dot images on both sides, the timings of starting and ending exposure are adjusted in such a manner that the beam spot on the photoconductor (exposure potential distribution) comes in the middle of the dot.

The timing of starting/ending exposure for each dot is not limited to the above when there are three dot images continuously arranged in the main scanning direction. For example, the timing of ending exposure (timing of ending light emission from a laser diode) can be brought forward for the first dot image, which is on the left side when viewed in the figure. The timing of starting exposure can be delayed for the third dot image, which is on the right side when viewed in the figure.

When there are more than three dot images continuously arranged in the main scanning direction, the configuration is similar to that when there are three dot images continuously arranged in the main scanning direction. That is, the timing of starting exposure is delayed for the first dot image to be formed by exposure, the timing of ending exposure is brought up for the last dot image to be formed by exposure, and for each of the dot images positioned in between dot images on both sides, the timings of starting and ending exposure are adjusted in such a manner that the beam spot on the photoconductor comes in the middle of the dot. As a matter of course, the timings are not limited to the above; it is possible to adjust the timings of starting and ending exposure for each dot.

Furthermore, it is possible to store a table in a memory, which is a table of association between numbers of dot images continuously arranged in the main scanning direction and timings for starting and ending exposure for each dot. When performing exposure for dot images continuously arranged in the main scanning direction, reference can be made to this table in order to find the starting/ending timings of exposure for each dot.

As described in practical example 3, by controlling the starting/ending timings of exposure for each dot in such a manner that the dots become bilaterally-symmetric, it is possible to prevent color shift and positional shift.

Practical Example 4

A description is given of practical example 4.

In the case of using a one-component developer, with the passage of time, the developer (toner) will become degraded and the toner charge amount will decrease. If the toner charge amount decreases, an increased amount of toner will adhere to the photoconductor. As a result, the actual density will become higher than the corresponding gradation level (the inclination of the line in the graph shown in FIG. 4 will become steep), and may deviate from the ideal line. Accordingly, in practical example 4, a table such as Table 2 is stored in the memory of the apparatus, which indicates exposure time lengths according to the association between endurable numbers of sheets and numbers of dot images continuously arranged in the main scanning direction.

TABLE 2

| No. of | Endurable number of sheets | | | | | |
|---|---|---|---|---|---|---|
| continuous dots | 0 | 1000 | 2000 | 3000 | 4000 | 5000 |
| 1 dot | 100% | 100% | 100% | 100% | 100% | 100% |
| 2 dots | 90% | 89% | 88% | 87% | 86% | 85% |
| 3 or more dots | 80% | 79% | 78% | 77% | 76% | 75% |

In the case of practical example 4, the engine control unit 200 counts the number of sheets on which images have been formed (number of image-formed sheets), and the accumulated value is stored in the memory. When the photoconductor is to be exposed with dot images, the number of image-formed sheets is read from the memory, and reference is made to the table to identify the exposure time corresponding to the number of image-formed sheets. When the photoconductor is to be exposed with dot images continuously arranged in the main scanning direction, the exposure time found from the table is applied to each dot image to perform the exposure.

Practical Example 5

A description is given of practical example 5.

In practical example 5, the optical sensor 15, acting as the toner density detecting unit for detecting the toner density of a toner image on the intermediate transfer belt 1, is disposed as shown in FIG. 1. Based on the toner density detection results obtained by the optical sensor 15, the exposure time is determined for dot images continuously arranged in the main scanning direction.

In practical example 5, when the number of image-formed sheets reaches a predetermined number or when the environment has changed by a predetermined amount, an exposure time changing mode is executed to make changes in the exposure times for dot images continuously arranged in the main scanning direction.

First, the engine control unit 200 prints patch images corresponding to low density gradation levels through high density gradation levels onto the intermediate transfer belt 1. Then, the optical sensor 15 detects the patch images, and adjusts the developing bias in such a manner that the image density of each one-dot image becomes a predetermined image density. Accordingly, an isolated one-dot image, which has the lowest gradation level, can be made to have an ideal density.

Figure 10:
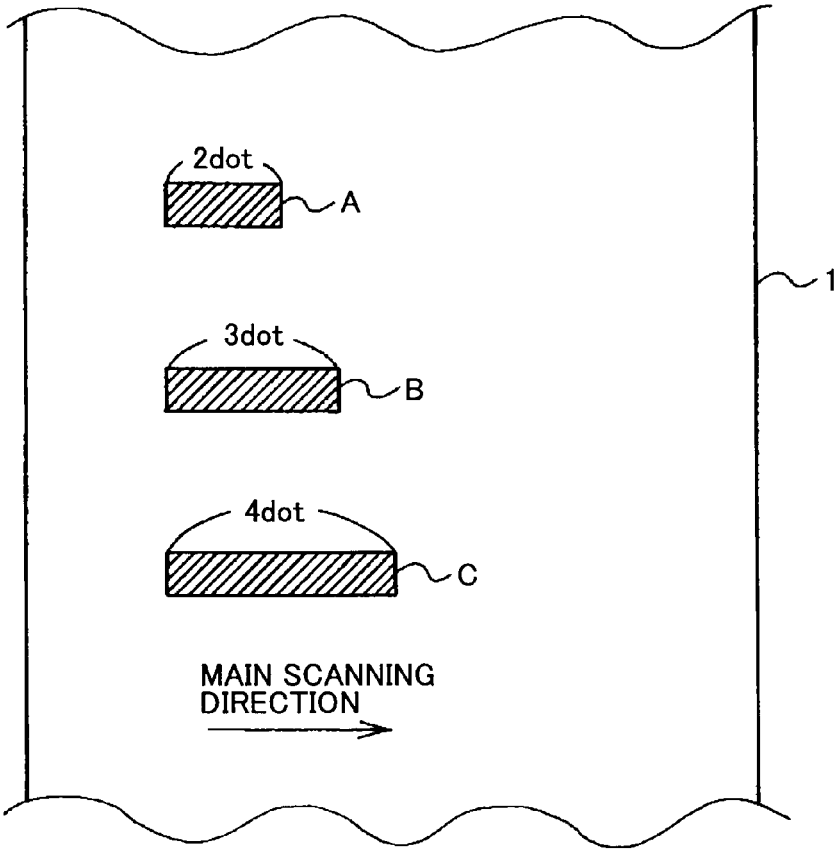
FIG. 10 illustrates examples of solid patch images formed on an intermediate transfer belt.
Figure 11:
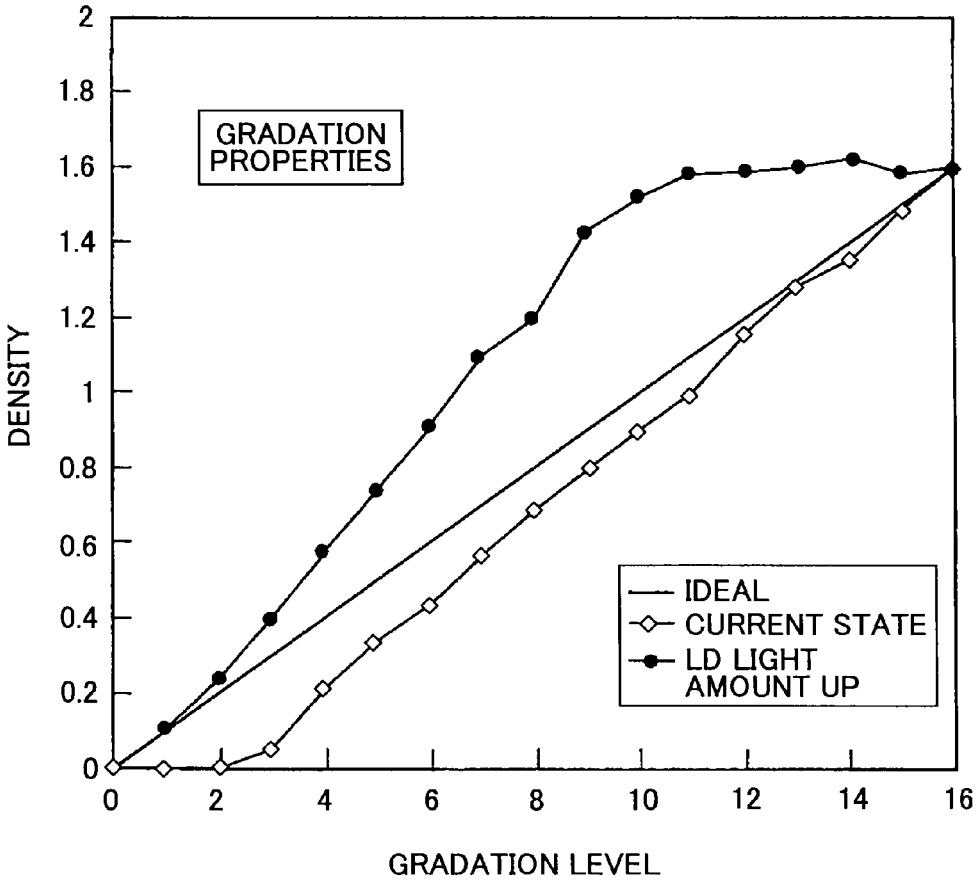
FIG. 11 is a graph indicating area gradation properties of the conventional technology and area gradation properties in a case where the LD light amount is increased.
Figure 12:
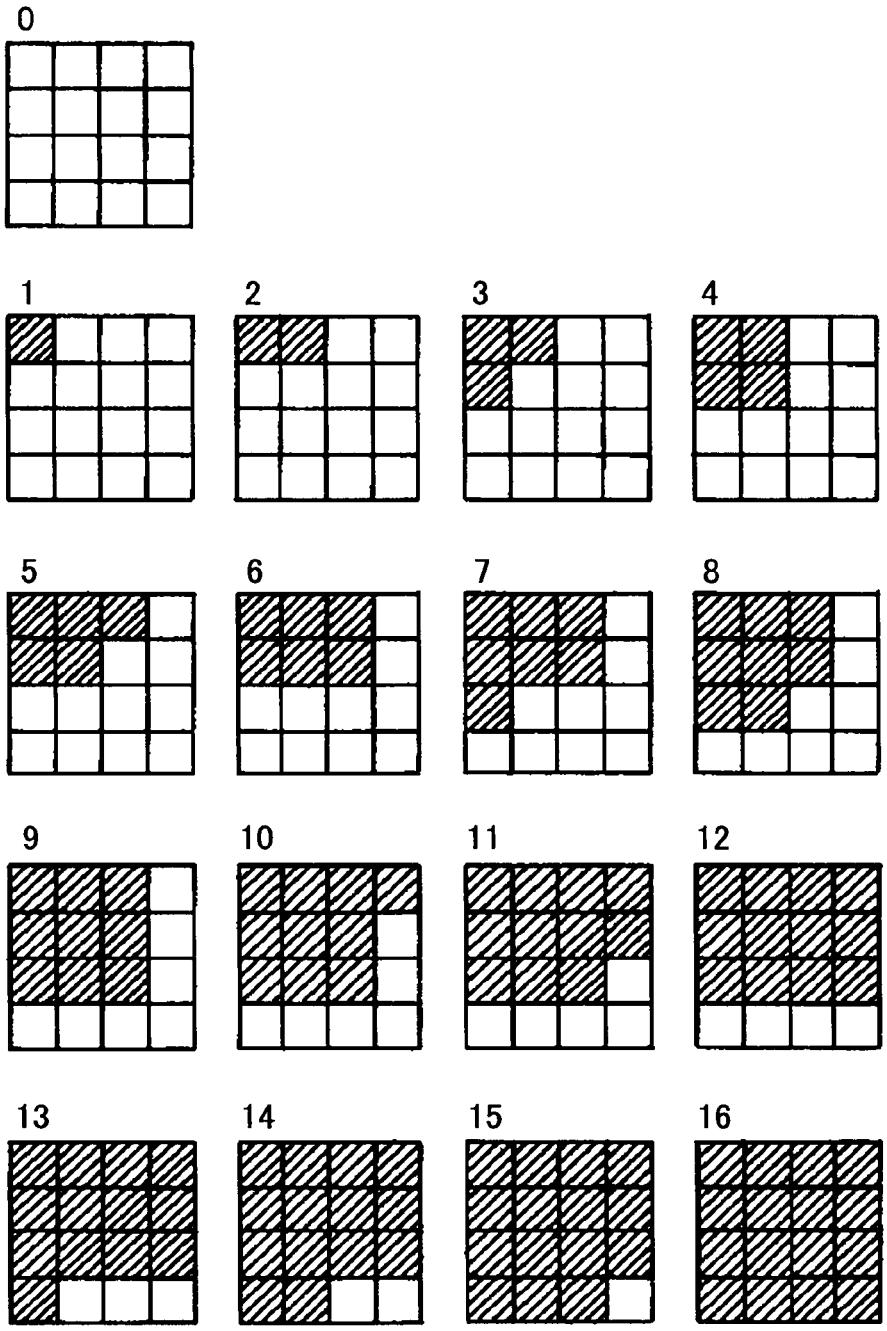
FIG. 12 is a diagram for describing area gradation.
Figure 13:
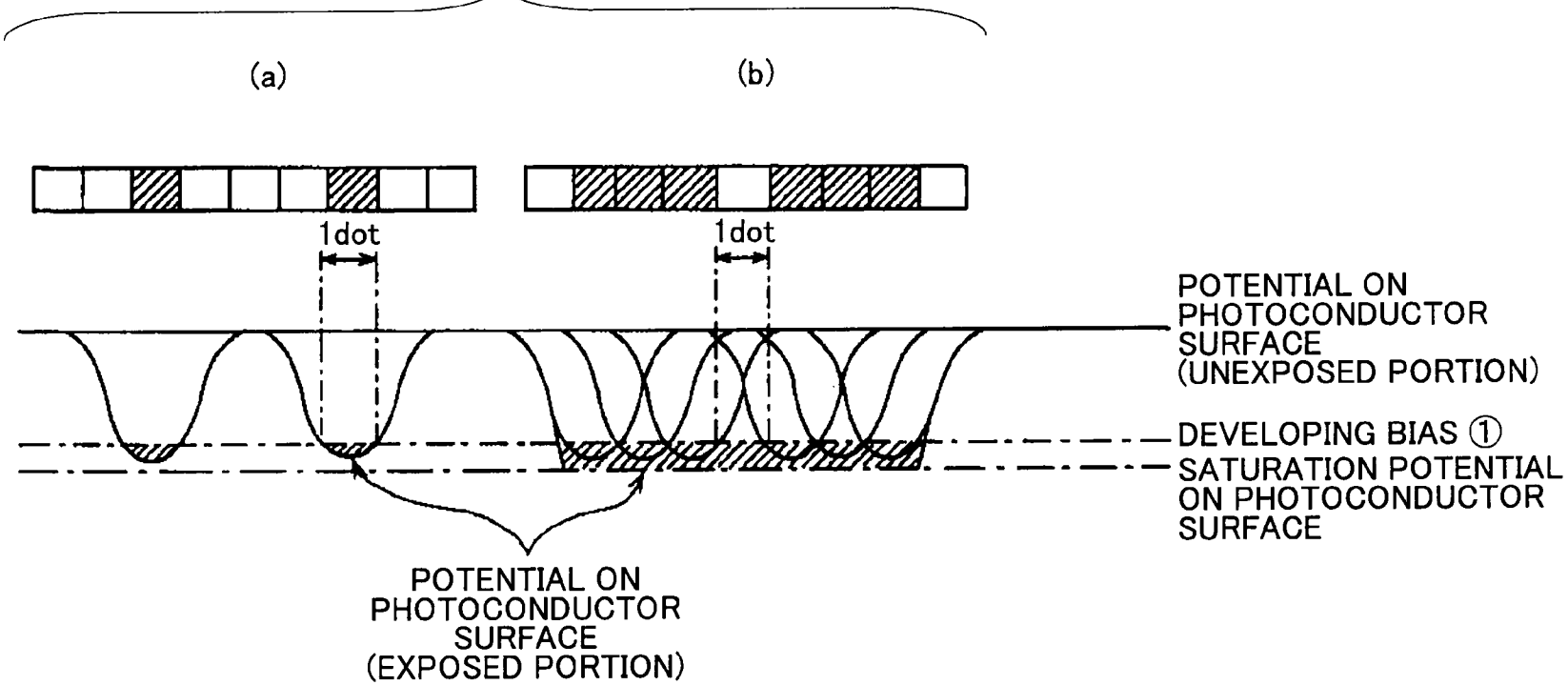
FIG. 13 illustrates potentials on a photoconductor surface, where (a) corresponds to a low density portion in the area gradation when the LD light amount is increased and (b) corresponds to a high density portion in the area gradation when the LD light amount is increased.
Figure 14:
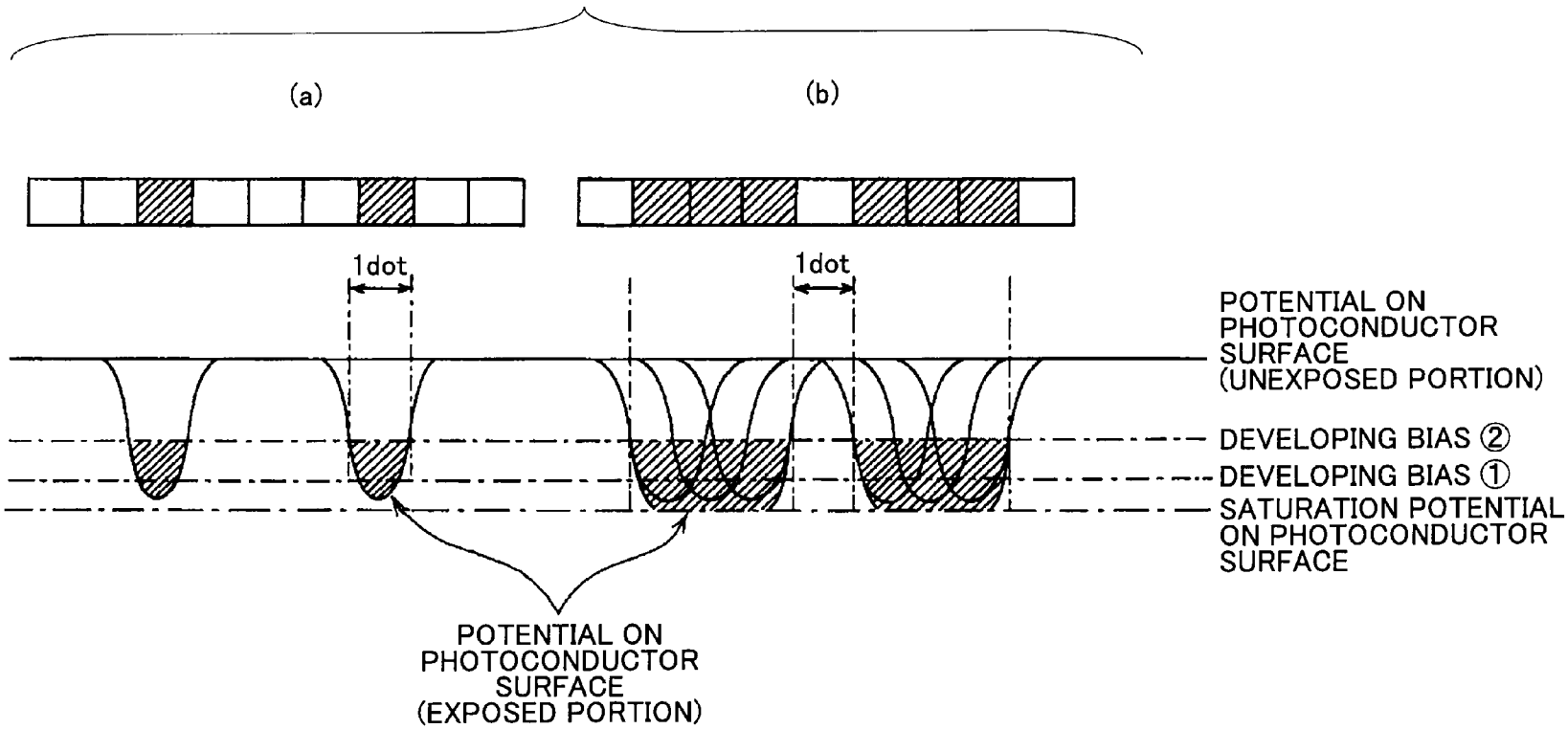
FIG. 14 illustrates potentials on a photoconductor surface, (a) corresponds to a low density portion in the area gradation when the developing bias is adjusted for properly reproducing isolated one-dot images, and (b) corresponds to a high density portion in the area gradation when the developing bias is adjusted for properly reproducing isolated one-dot images.

In order to determine the developing bias which makes an isolated one-dot image have a predetermined density, solid images having different numbers of dots (pixels) continuously arranged in the main scanning direction are formed on the surface of the photoconductor as shown in FIG. 10. In the first embodiment, the area gradation properties are expressed with a matrix of 4 dots×4 dots=16 dots. Hence, as for solid patch images, a solid patch image A including two continuous dots (pixels) in the main scanning direction, a solid patch image B including three continuous dots (pixels) in the main scanning direction, and a solid patch image C including four continuous dots (pixels) in the main scanning direction are formed at predetermined intervals as shown in FIG. 10.

Next, these solid patch images A through C are transferred onto the intermediate transfer belt 1 and are detected by the optical sensor 15. Then, the exposure time, which is applied when there are two continuous dot (pixel) images, is changed in such a manner that the solid patch image A is made to have a predetermined image density. Similarly, the exposure time, which is applied when there are three continuous dot (pixel) images, is changed in such a manner that the solid patch image B is made to have a predetermined image density. The exposure time can be adjusted in such a manner that all three dots have a uniform exposure time as in practical example 1, or the exposure time can be adjusted in such a manner that the middle dot and the dots on both sides have different exposure times as in practical example 2. Furthermore, the exposure time, which is applied when there are four continuous dot images, is changed in such a manner that the solid patch image C is made to have a predetermined image density.

It is also possible to make adjustments as follows. That is, in order to determine the developing bias that makes an isolated one-dot image have a predetermined density, patch images corresponding to ninth through twelfth gradation levels are formed. The exposure time applied when there are two continuous dot images in the main scanning direction and the exposure time applied when there are three continuous dot images in the main scanning direction are adjusted in such a manner that each of the image densities corresponding to the ninth through twelfth gradation levels becomes the predetermined image density.

Furthermore, it is also possible to make the following adjustments. That is, color shift detection patches are formed for detecting color shift, and these color shift detection patches are detected by the optical sensor 15. Based on the detection results, as described in practical example 3, the timings for starting and ending exposure for continuously-arranged dot images are adjusted so that color shift is prevented.

Moreover, it is also possible to make adjustments by repeating the operations of adjusting the exposure time→creating patch images→detecting the image density, until an optimum density is attained. Furthermore, although the precision may decrease to some extent, the exposure time can be adjusted by referring to a table in order to reduce the consumption amount of toner and to reduce the time spent on making the adjustments.

In this case, a table will be stored in the memory, which indicates exposure time correction amounts associated with the difference between patch image densities and optimum densities. The difference between the detection result obtained with the optical sensor 15 and the optimum density is calculated, and the exposure time correction amount is searched for and extracted from the table. Based on the search-found exposure time correction amount, the exposure time is corrected, and the corrected exposure time is stored in the memory.

The exposure time applied when there are continuous dot images can be determined in consideration of dot image information in the sub scanning direction. For example, when dot images continuously arranged in the main scanning direction have adjacent dot images in the sub scanning direction that are continuously arranged, the exposure time can be made shorter than that in the case where the adjacent dot images in the sub scanning direction are not continuously arranged. If the exposed portions are superposed with potentials of surrounding exposed portions, the potential of the exposed portions will decrease more than necessary, which will increase the density of the exposed portions more than necessary. However, these disadvantages can be prevented by reducing the exposure time. Furthermore, for example, when a dot adjacent to continuous dot images is a non-image dot that is surrounded by dot images (an isolated non-image dot), it is possible to adjust the exposure start timing or the exposure end timing for the dot images adjacent to the isolated non-image dot in the main scanning direction. For example, if there is an isolated non-image dot at an upstream position in the exposure scanning direction with respect to target continuous dot images, the exposure start timings will be delayed. Conversely, if there is an isolated non-image dot at a downstream position in the exposure scanning direction with respect to target continuous dot images, the exposure end timings will be brought up. Accordingly, it is possible to prevent regions corresponding to non-image dots from being exposed, so that gradation loss is mitigated.

Furthermore, in the above description, the densities of isolated one-dot images are stabilized by adjusting the developing bias; however, an embodiment of the present invention is also applicable to a method of stabilizing densities of isolated one-dot images by intensifying the LD power (exposure energy).

A description is given of a second embodiment of the present invention.

The configurations of the image forming apparatus, the developing devices, and the control units for controlling the image forming apparatus according to the second embodiment are the same as those of the first embodiment described with reference to FIGS. 1 through 3, and are thus not further described; only the characteristics of the second embodiment are described.

In the second embodiment, the exposure energy is changed according to the number of dot images continuously arranged in the main scanning direction to attain favorable area gradation properties with an image forming apparatus employing a contact-type developing method performed with the use of a non-magnetic one-component developer.

Details are described below in practical examples A through D.

Practical Example A

First, a description is given of practical example A.

Figure 15:
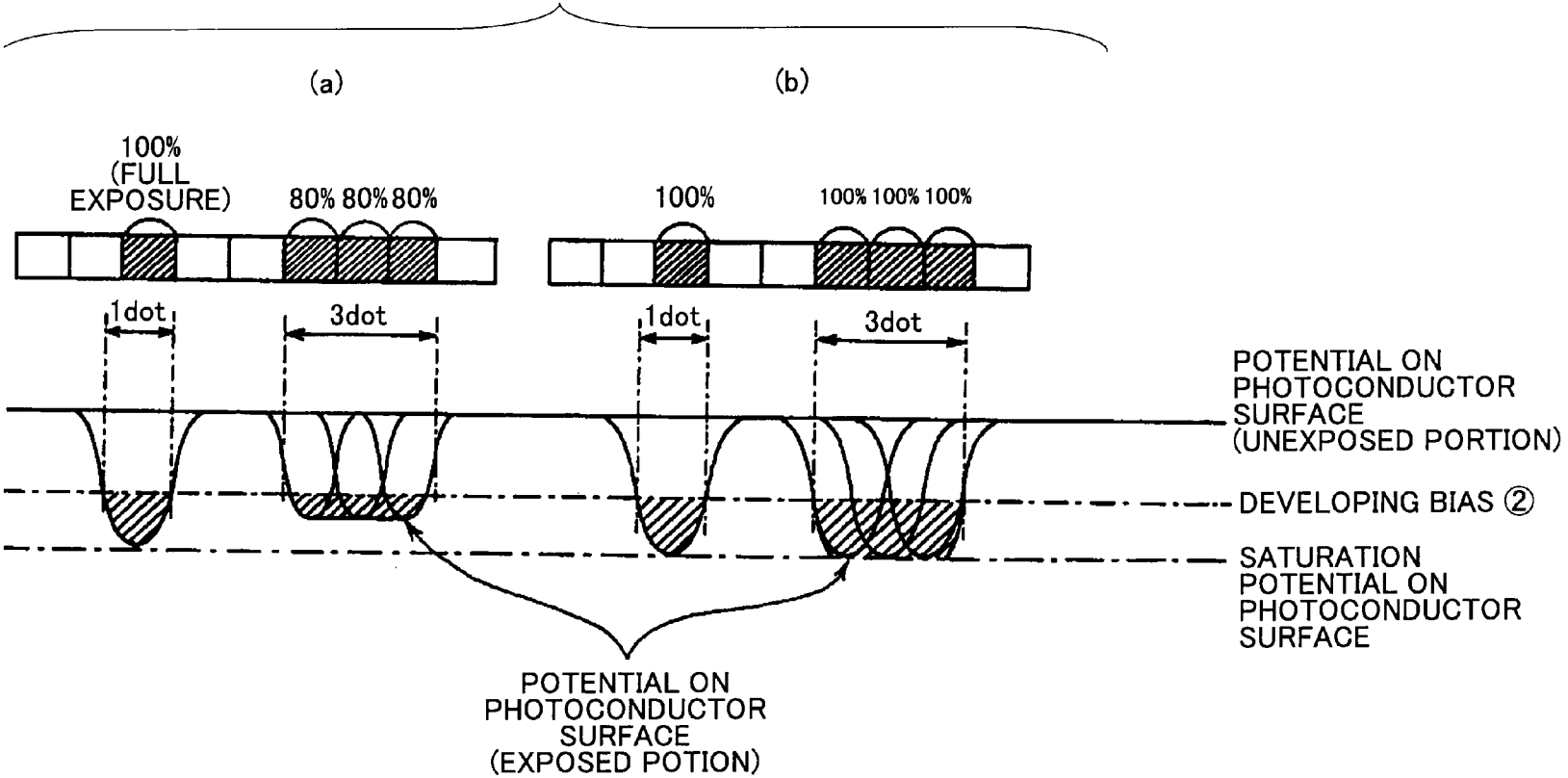
FIG. 15 illustrates potentials on a photoconductor surface, where (a) corresponds to practical example 2 and (b) corresponds to the conventional technology.

In FIG. 15, (a) illustrates an example of potentials on a photoconductor surface according to the second embodiment of the present invention. In FIG. 15, (b) illustrates an example of potentials on a photoconductor surface when the exposure energy has not been changed according to the continuous dot images.

The engine control unit 200 searches the data corresponding to dots in the line memory for portions of continuously-arranged dots used for exposing the surface of the photoconductor by emitting light from a laser diode (hereinafter, "dot images"). If there is a dot image without any dot images on both sides thereof in the main scanning direction, i.e., if there is an isolated dot image, the photoconductor surface will be exposed with the isolated dot image with maximum exposure energy (100%), as shown in (a) of FIG. 15. On the other hand, if there are dot images continuously arranged in the main scanning direction, the exposure will be performed with lower exposure energy than that of the isolated dot image. If there are two or more dot images continuously arranged in the main scanning line direction, the exposure will be performed by decreasing the exposure energy of each dot image by 20% from that of the isolated dot image, as shown in (a) of FIG. 15.

As shown in (b) of FIG. 15, when the exposure energy has not been changed for the continuous dot images, the developing potential (the difference between the developing bias and the potential of exposed portions of the photoconductor surface) is large where three dot images are continuously arranged. As a result, a large amount of toner will adhere to this portion. In the case shown in (a) of FIG. 15, at portions where dot images are continuously arranged, the exposure energy for each dot image is decreased compared to that for an isolated dot image. Therefore, the exposure amount is reduced, and the width and depth of each beam spot is reduced on the photoconductor surface. Consequently, the developing potential is reduced where three dot images are continuously arranged, so that the amount of adhering toner can be maintained at an optimum level.

Figure 16:
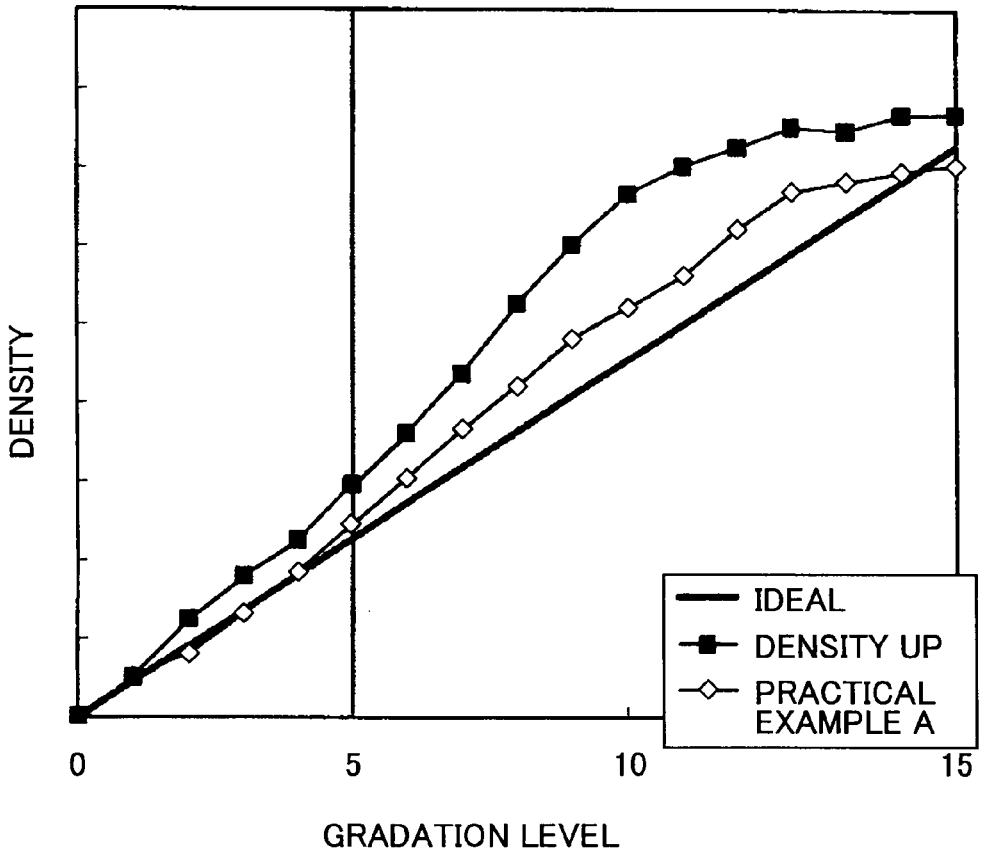
FIG. 16 is a graph indicating area gradation properties of practical example A and area gradation properties in a case where the developing bias is adjusted to attain favorable reproducibility of isolated one dot images.

As indicated by a line joining ■ marks in the graph shown in FIG. 16, in the conventional technology where the developing bias is increased in an attempt to optimize densities of isolated one-dot images, favorable reproducibility is attained in the low density portions of the area gradation including less continuous dot images; however, the densities significantly exceed the ideal densities in the mid-density portions to high density portions where more continuous dot images are included compared to the low density portions.

As indicated by a line joining ◇ marks in the graph shown in FIG. 16, in the second embodiment, favorable reproducibility is attained for isolated one-dot images and the density of a solid image at the sixteenth gradation level is close to the ideal value. Accordingly, the area gradation properties are significantly improved from those of the conventional technology.

In practical example A, when there are two or more dot images continuously arranged, the exposure energy levels for respective ones of the dot images are uniformly decreased by 20% with respect to that of an isolated dot image; however, the present invention is not limited thereto. The exposure energy can be decreased according to the number of pixels. Such a configuration is described below as practical example B.

Practical Example B

In practical example A, the exposure energy levels are uniformly decreased for continuously-arranged dot images. However, with such a configuration, as shown in FIG. 16, it was found that the density exceeds the ideal density around the fifth gradation level and above. This is attributed to the fact that three or more dot images continuously arranged in the main scanning direction start to appear from the fifth gradation level. A dot image positioned in between dot images (a dot image with dot images on both sides thereof in the main scanning direction) is affected by latent image potentials of the dot images on both sides thereof in the main scanning direction. For this reason, the dot image positioned in between dot images will have a high density. Thus, the density somewhat exceeds the ideal density around the fifth gradation level and above.

Accordingly, in practical example B, the following measure is taken to eliminate the excessive densities at the fifth gradation level and above. That is, the exposure energy applied when there are three or more dot images in the main scanning direction is lower than that applied when there are two continuous dot images.

Specifically, when there are dot images in two continuous pixels, the exposure energy for each pixel is decreased by 20% from that of an isolated dot image. When there are dot images in three or more continuous pixels, the exposure energy for each pixel is decreased by 30% from that of an isolated dot image.

Figure 17:
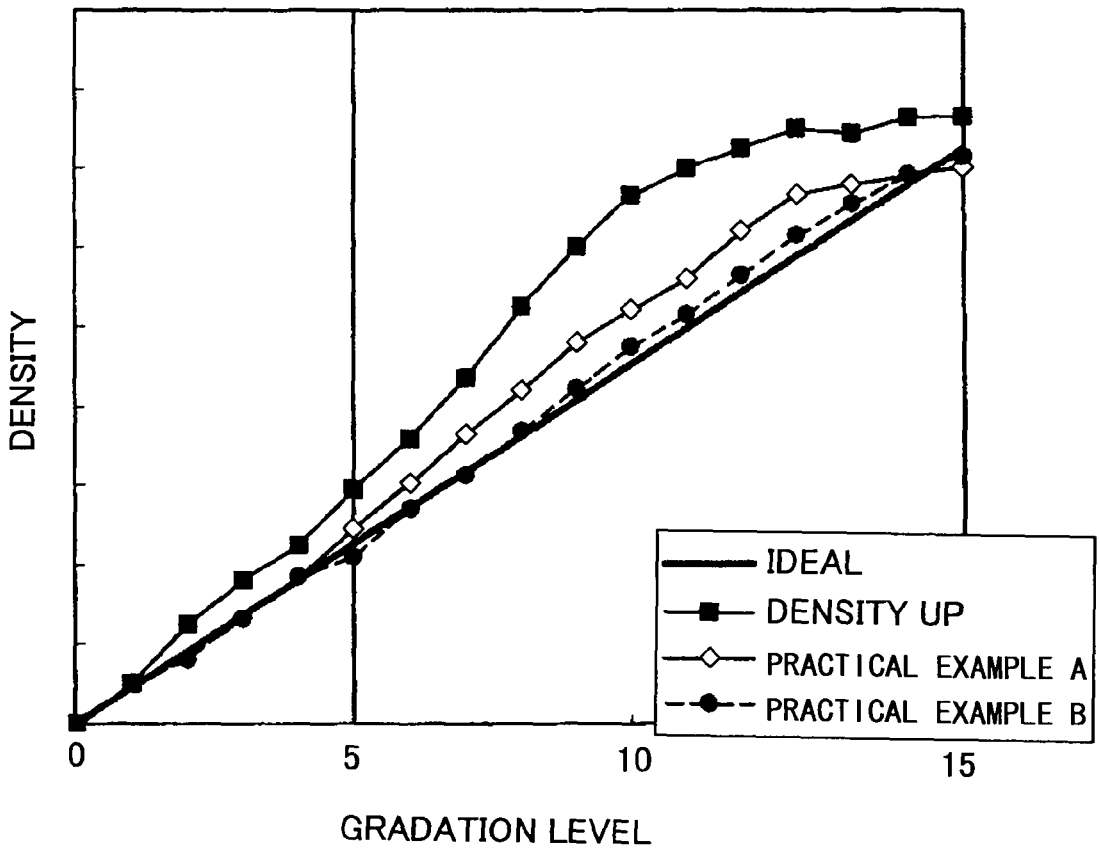
FIG. 17 is a graph indicating area gradation properties of practical example A, area gradation properties of practical example B, and area gradation properties in a case where the developing bias is adjusted to attain favorable reproducibility of isolated one dot images.

As shown in FIG. 17, in practical example B, excessive densities at the fifth gradation level and above are improved. The exposure energy is lower for dot images in three or more continuous pixels than that for dot images in two continuous pixels. Therefore, the width of the latent image potential in the main scanning direction of dot images in three or more continuous pixels is shorter than that of dot images in two continuous pixels. For this reason, the dot image positioned in between dot images can be less affected by the latent image potentials of dot images on both sides of the dot image in the main scanning direction. As a result, it is possible to prevent an increase in the density of the dot image positioned in between dot images. This configuration mitigates the excessive densities at the fifth gradation level and above, where three or more dot images continuously arranged in the main scanning direction start to appear.

Table 3 includes quantified results of the extent to which the linearity was improved in the following cases: a conventional case where the reproducibility of isolated one-dot images was enhanced only by increasing the LD light amount; and cases of practical examples A and B where the reproducibility of isolated one-dot images was enhanced by adjusting the developing bias and by decreasing the exposure energy for continuous dot images compared with that of isolated one-dot images. The quantified values were calculated with the use of the square of Pearson's product-moment correlation coefficient γ.

TABLE 3

| | LD light quantity UP | Bias UP | Practical Example 1 | Practical Example 2 | (Ideal) |
|---|---|---|---|---|---|
| $r^2$ | 0.931 | 0.954 | 0.984 | 0.998 | 1.000 |

The results in Table 3 say that the linearity has been improved in practical example A compared to the conventional technology. Furthermore, with the configuration as described in practical example B, the linearity is further improved.

Practical Example C

In the case of using a one-component developer, the developer (toner) becomes degraded with the passage of time, and the toner charge amount decreases. If the toner charge amount decreases, an increased amount of toner will adhere to the photoconductor. As a result, the density will become higher than the corresponding gradation level (the inclination of the line in the graph shown in FIG. 16 will become steep), and may deviate from the ideal line.

Accordingly, in practical example C, a table such as Table 4 is stored in the memory of the apparatus, indicating exposure times according to the association between endurable numbers of sheets and numbers of dot images continuously arranged in the main scanning direction.

TABLE 4

| No. of | Endurable number of sheets | | | | | |
|---|---|---|---|---|---|---|
| continuous dots | 0 | 1000 | 2000 | 3000 | 4000 | 5000 |
| 1 dot | 100% | 100% | 100% | 100% | 100% | 100% |
| 2 dots | 80% | 75% | 72% | 70% | 69% | 68% |
| 3 or more dots | 70% | 65% | 62% | 60% | 59% | 58% |

In the case of practical example C, the engine control unit 200 counts the number of sheets on which images have been formed (number of image-formed sheets), and the accumulated value is stored in the memory. When the photoconductor is to be exposed with dot images, the number of image-formed sheets is read from the memory, and reference is made to the table to identify the exposure energy level corresponding to the number of image-formed sheets. When the photoconductor is to be exposed with dot images continuously arranged in the main scanning direction, the exposure energy level found from the table is applied to each dot image to perform the exposure.

Practical Example D

A description is given of practical example D.

In practical example D, the optical sensor 15 acting as the toner density detecting unit for detecting the toner density of a toner image on the intermediate transfer belt 1 is disposed as shown in FIG. 1. Based on the toner density detection results obtained by the optical sensor 15, the exposure energy level is determined for dot images continuously arranged in the main scanning direction.

In practical example D, when the number of image-formed sheets reaches a predetermined number or when the environment has changed by a predetermined amount, an exposure time changing mode is executed to make changes in the exposure energy levels for dot images continuously arranged in the main scanning direction.

First, the engine control unit 200 prints patch images corresponding to low density gradation levels through high density gradation levels onto the intermediate transfer belt 1. Then, the optical sensor 15 detects the patch images, and adjusts the developing bias in such a manner that the image density of each one-dot (pixel) becomes a predetermined image density. Accordingly, an isolated one-dot image, which has the lowest gradation level, can be made to have an ideal density.

In order to determine the developing bias that makes an isolated one-dot image have a predetermined density, solid images having different numbers of dots (pixels) continuously arranged in the main scanning direction are formed on the surface of the photoconductor as shown in FIG. 10. In the second embodiment, the area gradation properties are expressed with a matrix of 4 dots×4 dots=16 dots. Hence, as for solid patch images, a solid patch image A including two continuous dots (pixels) in the main scanning direction, a solid patch image B including three continuous dots (pixels) in the main scanning direction, and a solid patch image C including four continuous dots (pixels) in the main scanning direction are formed at predetermined intervals as shown in FIG. 10.

Next, these solid patch images A through C are transferred onto the intermediate transfer belt 1 and are detected by the optical sensor 15. Then, the exposure energy level, which is applied when there are two continuous dot (pixel) images, is changed in such a manner that the solid patch image A is made to have a predetermined image density. Similarly, the exposure energy level, which is applied when there are three continuous dot (pixel) images or four continuous dot (pixel) images, is changed in such a manner that the solid patch image B is made to have a predetermined image density. When the exposure energy level is adjusted in such a manner that all continuously-arranged dots have a uniform exposure energy level as in practical example A, the exposure energy level is adjusted to be an optimum energy level based on detection results from solid patch images A through C, so that the solid patch images A through C have favorable image densities.

The present invention is not limited to the above; it is also possible to make adjustments as follows. That is, in order to determine the developing bias that makes an isolated one-dot image have a predetermined density, patch images corresponding to the fifth gradation level and above are formed. The exposure energy applied when there are two continuous pixels in the main scanning direction and the exposure energy applied when there are three or more continuous pixels in the main scanning direction are adjusted such that each of the image densities corresponding to the fifth gradation level and above becomes the predetermined image density.

Moreover, it is also possible to make adjustments by repeating the operations of adjusting the exposure energy→creating patch images→detecting the image density, until an optimum density is attained. Furthermore, although the precision may decrease to some extent, the exposure energy can be adjusted by referring to a table in order to reduce the consumption of toner and to reduce the time spent on making the adjustments.

In this case, a table may be stored in the memory, which indicates exposure energy correction amounts associated with the difference between patch image densities and optimum densities. The difference between the detection result obtained with the optical sensor 15 and the optimum density is calculated, and the exposure energy correction amount is searched for and extracted from the table. Based on the search-found exposure energy correction amount, the exposure energy amount is corrected, and the corrected exposure energy amount is stored in the memory.

The exposure energy applied when there are continuous dot images can be determined in consideration of dot image information in the sub scanning direction. For example, when dot images continuously arranged in the main scanning direction have adjacent pixels in the sub scanning direction that are dot images continuously arranged in the main scanning direction, the exposure energy can be made lower than that in the case where the adjacent pixels in the sub scanning direction are not continuously arranged. If the exposed portions are superposed with potentials of surrounding exposed portions, the potential of the exposed portions will decrease more than necessary, which will increase the density of the exposed portions more than necessary. However, these disadvantages can be prevented by reducing the exposure energy.

In the second embodiment, densities of isolated one-dot images can be stabilized by adjusting the developing bias, or by intensifying the LD power (exposure energy).

In the image forming apparatus according to the first and second embodiments of the present invention, the developing bias or the exposure energy is adjusted in such a manner that an isolated one-dot image has a predetermined density. Accordingly, it is possible to attain favorable gradation properties in low density portions in area gradation in a contact-type developing method performed with the use of a non-magnetic one-component developer. When exposing the photoconductor to form dot images continuously arranged in a main scanning direction, the width of the latent image potential distribution in the main scanning direction corresponding to each of the dot images on the surface of the photoconductor is reduced by reducing the exposure time or the exposure energy. Accordingly, it is possible to mitigate the impact of the latent image potential of a dot image on the latent image potential of an adjacent dot image in the main scanning direction. This mitigates significant attenuation of the potential on the photoconductor where dot images are continuously arranged, thus mitigating an increase in the developing potential. As a result, it is possible to mitigate increases in densities in mid-density portions to high density portions in the area gradation, where there are more dot images continuously arranged in the main scanning direction than in the low density portions. Furthermore, the potential of an isolated non-image dot, which is positioned in between dot images continuously arranged in the main scanning direction, will attenuate to the level of the potential of exposed portions due to the impact of the latent image potential of the portion of the dot images continuously arranged in the main scanning direction on both sides of the isolated non-image dot; however, according to the first and second embodiments of the present invention, it is possible to prevent such attenuation. Accordingly, gradation loss in the high density portions can be mitigated. As a result, it is possible to attain favorable area gradation properties in the contact-type developing method performed with the use of a non-magnetic one-component developer.

Furthermore, in the image forming apparatus according to the first embodiment of the present invention, the exposure time is reduced when exposing the photoconductor to form dot images continuously arranged in the main scanning direction. Accordingly, the width of a latent image potential distribution in the main scanning direction corresponding to each of the dot images continuously arranged in the main scanning direction can be made shorter than that of an isolated one-dot image. As a result, it is possible to mitigate increases in densities in mid-density portions to high density portions in the area gradation, and to mitigate gradation loss in the high density portions. Accordingly, favorable area gradation properties can be attained.

Furthermore, as described in practical example 2, when there are three or more dot images continuously arranged in the main scanning direction, the exposure time period of exposing the photoconductor to form a middle dot image positioned in between edge dot images is made shorter than the exposure time period of forming the edge dot images. Accordingly, it is possible to mitigate decreases in densities at the ninth through twelfth gradation levels, and therefore even more favorable area gradation properties can be attained.

Furthermore, as described in practical example 3, the exposure timing of exposing the photoconductor to form each of the dot images continuously arranged in the main scanning direction is determined such that the dot images continuously arranged in the main scanning direction are bilaterally-symmetric with respect to a center position of all the dot images. Accordingly, the dot images continuously arranged in the main scanning direction become bilaterally-symmetric with respect to a center position of all the dot images, thus mitigating image noises such as color shift and positional shift.

Furthermore, as described in practical example 4, there is provided a table of association between numbers of dot images continuously arranged in the main scanning direction, and exposure time periods of exposing the image carrier to form respective ones of dot images. The exposure time period is determined according to the table and the number of the dot images continuously arranged in the main scanning direction. Accordingly, the exposure time period can be determined by referring to the table.

Furthermore, as described in practical example 5, the exposure time period and/or the exposure timing of exposing the photoconductor with dot images continuously arranged in the main scanning direction are determined based on detection results obtained by detecting a detection toner image. Accordingly, compared to the case of determining uniform exposure time periods and/or exposure timings based on the number of dot images continuously arranged in the main scanning direction, more favorable area gradation properties can be attained.

Furthermore, as described in practical example 5, there is provided a table of association between toner densities, numbers of dot images continuously arranged in the main scanning direction in the toner image, and exposure time periods and/or exposure timings of exposing the image carrier to form respective ones of dot images. Accordingly, it is possible to determine an optimum exposure time period and/or exposure timing of exposing the photoconductor to form dot images continuously arranged in the main scanning direction based on the table, the toner density, and the number of dot images continuously arranged in the main scanning direction in the toner image. Accordingly, the process of optimizing the exposure time period and/or exposure timing can be performed within a shorter time period compared to the method of determining the optimum exposure time period and/or exposure timing by repeating the operations of adjusting the exposure time period and/or exposure timing→creating a detection pattern→detecting the detection pattern, until the detection result obtained by detecting the detection pattern reaches a target value.

When the image carrier is exposed to form the isolated one-dot image, the image carrier is exposed to form the isolated one-dot image with full exposure. Therefore, compared to a case of not forming the isolated one-dot image with full exposure, it is possible to mitigate losses in usage efficiencies of laser beams.

The exposure time period and/or exposure timing of exposing the photoconductor to form dot images continuously arranged in the main scanning direction are determined according to the number of the dot images continuously arranged in the main scanning direction and the number of dot images surrounding the dot images continuously arranged in the main scanning direction. Accordingly, even more favorable area graduation properties can be attained.

In the image forming apparatus according to the second embodiment of the present invention, the exposure energy is made lower when the image carrier is exposed to form the dot images continuously arranged in the main scanning direction. Accordingly, the width of the latent image potential distribution in the main scanning direction corresponding to each of the dot images continuously arranged in the main scanning direction can be made shorter than that corresponding to an isolated one-dot image. As a result, it is possible to mitigate increases in densities in mid-density portions to high density portions in the area gradation, and to mitigate gradation loss in the high density portions. Accordingly, favorable area gradation properties can be attained.

Furthermore, as described in practical example B, the exposure energy is controlled to be different according to a number of dot images continuously arranged in the main scanning direction. For example, when there are three or more dot images continuously arranged in the main scanning direction, the exposure energy for each dot image is made lower than that when there are two continuous dot images. Accordingly, even more favorable area gradation properties can be attained compared to the case of applying the same exposure energy for each of the dot images continuously arranged in the main scanning direction regardless of the number of dots continuously arranged in the main scanning direction.

Furthermore, as described in practical example C, there is provided a table of association between numbers of dot images continuously arranged in the main scanning direction, and exposure energy for exposing the photoconductor to form respective ones of dot images. The exposure energy is determined according to the table and the number of the dot images continuously arranged in the main scanning direction. Accordingly, the exposure energy can be determined by referring to the table.

Furthermore, as described in practical example D, the exposure energy for exposing the photoconductor with dot images continuously arranged in the main scanning direction is determined based on detection results obtained by detecting a detection toner image. Accordingly, compared to the case of applying uniform exposure energy based on the number of dot images continuously arranged in the main scanning direction, more favorable area gradation properties can be attained.

Furthermore, as described in practical example D, there is provided a table of association between toner densities, numbers of dot images continuously arranged in the main scanning direction in the toner image, and exposure energy for exposing the image carrier to form respective ones of dot images. Accordingly, it is possible to determine optimum exposure energy for exposing the photoconductor to form dot images continuously arranged in the main scanning direction based on the table, the toner density, and the number of dot images continuously arranged in the main scanning direction in the toner image. Accordingly, the process of optimizing the exposure energy can be performed within a shorter time period compared to the method of determining the optimum exposure energy by repeating the operations of adjusting the exposure energy→creating a detection pattern→detecting the detection pattern, until the detection result obtained by detecting the detection pattern reaches a target value.

Furthermore, the exposure energy for exposing the image carrier to form each of the dot images continuously arranged in the main scanning direction is determined according to a number of dot images surrounding the dot images continuously arranged in the main scanning direction. Accordingly, even more favorable area gradation properties can be attained.

According to one embodiment of the present invention, an image forming apparatus includes an image carrier; an exposing unit configured to expose a surface of the image carrier with exposure energy based on image data corresponding to dot images to form a latent image; and a developing unit configured to perform a developer contact developing method by applying a developing bias onto a developer carrier carrying a non-magnetic one-component developer and causing the non-magnetic one-component developer on the developer carrier to contact the image carrier, thereby developing the latent image on the image carrier into a toner image, wherein the toner image on the image carrier is transferred onto a recording material, either directly or via a surface of an intermediate transfer body; and the developing bias or the exposure energy is adjusted such that an isolated one-dot image has a predetermined image density, the image forming apparatus further including a control unit configured to control the exposing unit in such a manner that, when the image carrier is exposed to form the dot images continuously arranged in a main scanning direction, a width of a latent image potential distribution in the main scanning direction corresponding to each of the dot images on the image carrier is shorter than that when the image carrier is exposed to form the isolated one-dot image.

Additionally, the control unit controls the exposing unit in such a manner that, when the image carrier is exposed to form the dot images continuously arranged in the main scanning direction, an exposure time period for each dot image is shorter than that when the image carrier is exposed to form the isolated one-dot image.

Additionally, the control unit controls the exposing unit in such a manner that, when the image carrier is exposed to form three or more dot images continuously arranged in the main scanning direction, the exposure time period for a middle dot image positioned in between edge dot images is shorter than that for each of the edge dot images.

Additionally, the control unit determines an exposure timing of exposing the image carrier to form each of the dot images continuously arranged in the main scanning direction, wherein the exposure timing is determined such that the dot images continuously arranged in the main scanning direction are bilaterally-symmetric with respect to a center position of the dot images.

Additionally, the image forming apparatus further includes a table of association between numbers of dot images continuously arranged in the main scanning direction, and exposure time periods of exposing the image carrier to form respective ones of dot images, wherein the exposure time period is determined according to the table and a number of the dot images continuously arranged in the main scanning direction.

Additionally, the image forming apparatus further includes a toner density detecting unit configured to detect a toner density of the toner image on the image carrier or on the intermediate transfer body, wherein a detection toner image is formed, the toner density of the detection toner image is detected by the toner density detecting unit, and the exposure time period of exposing the image carrier to form each of the dot images continuously arranged in the main scanning direction is determined according to detection results obtained by the toner density detecting unit.

Additionally, the image forming apparatus further includes a table of association between toner densities, numbers of dot images continuously arranged in the main scanning direction in the toner image, and exposure time periods of exposing the image carrier to form respective ones of dot images, wherein the exposure time period of exposing the image carrier to form each of the dot images continuously arranged in the main scanning direction is determined according to the table, the toner density, and the number of dot images continuously arranged in the main scanning direction in the toner image.

Additionally, when the image carrier is exposed to form the isolated one-dot image, the image carrier is exposed to form the isolated one-dot image with full exposure.

Additionally, the exposure time period of exposing the image carrier to form each of the dot images continuously arranged in the main scanning direction is determined according to a number of the dot images continuously arranged in the main scanning direction and a number of dot images surrounding the dot images continuously arranged in the main scanning direction.

Additionally, the control unit controls the exposing unit in such a manner that, when the image carrier is exposed to form the dot images continuously arranged in the main scanning direction, the exposure energy for each dot image is lower than that when the image carrier is exposed to form the isolated one-dot image.

Additionally, the control unit controls the exposure energy to be different according to a number of dot images continuously arranged in the main scanning direction.

Additionally, the image forming apparatus further includes a table of association between numbers of dot images continuously arranged in the main scanning direction, and exposure energy for exposing the image carrier to form respective ones of dot images, wherein the exposure energy is determined according to the table and a number of the dot images continuously arranged in the main scanning direction.

Additionally, the image forming apparatus further includes a toner density detecting unit configured to detect a toner density of the toner image on the image carrier or on the intermediate transfer body, wherein a detection toner image is formed, the toner density of the detection toner image is detected by the toner density detecting unit, and the exposure energy for exposing the image carrier to form each of the dot images continuously arranged in the main scanning direction is determined according to detection results obtained by the toner density detecting unit.

Additionally, the image forming apparatus further includes a table of association between toner densities, numbers of dot images continuously arranged in the main scanning direction in the toner image, and exposure energy for exposing the image carrier to form respective ones of dot images, wherein the exposure energy for exposing the image carrier to form each of the dot images continuously arranged in the main scanning direction is determined according to the table, the toner density, and the number of dot images continuously arranged in the main scanning direction in the toner image.

Additionally, the exposure energy for exposing the image carrier to form each of the dot images continuously arranged in the main scanning direction is determined according to a number of the dot images continuously arranged in the main scanning direction and a number of dot images surrounding the dot images continuously arranged in the main scanning direction.

According to one embodiment of the present invention, an image forming method includes the steps of forming a latent image on a surface of an image carrier by exposing the surface of the image carrier based on input image data corresponding to dot images; and developing the latent image on the image carrier by performing a developer contact developing method with the use of a non-magnetic one-component developer, wherein when the image carrier is exposed to form the dot images continuously arranged in a main scanning direction, a width of a latent image potential distribution in the main scanning direction corresponding to each of the dot images on the image carrier is shorter than that when the image carrier is exposed to form the isolated one-dot image.

Additionally, when the image carrier is exposed to form the dot images continuously arranged in the main scanning direction, an exposure time period for each dot image is shorter than that when the image carrier is exposed to form the isolated one-dot image.

Additionally, when the image carrier is exposed to form the dot images continuously arranged in the main scanning direction, the exposure energy for each dot image is lower than that when the image carrier is exposed to form the isolated one-dot image.

Favorable gradation properties at low density portions in an area gradation can be attained by adjusting a developing bias or exposure energy in such a manner that an isolated one-dot image has a predetermined density. However, when the developing bias or exposure energy is adjusted in such a manner that an isolated one-dot image has a predetermined density, in a contact-type developing method performed with the use of a non-magnetic one-component developer, the image density of each of the dot images continuously arranged in the main scanning direction may increase or gradation loss may occur as the potential of a non-image dot positioned in between dot images continuously arranged in the main scanning direction decreases to the level of a potential of exposed portions. As a result, there may be an increased number of dot images continuously arranged in the main scanning direction, or an isolated non-image dot may appear positioned in between dot images continuously arranged in the main scanning direction, thus degrading the gradation properties at mid-density portions to high density portions in the area gradation.

Accordingly, in the present invention, when the image carrier is exposed to form the dot images continuously arranged in a main scanning direction, a width of a latent image potential distribution in the main scanning direction corresponding to each of the dot images on the image carrier is shorter than that when the image carrier is exposed to form the isolated one-dot image. Thus, latent image potentials corresponding to continuous dot images that are adjacent to (on opposite sides of) the isolated non-image dot in the main scanning direction are not overlapping each other, and therefore the potential of the isolated non-image dot will not decrease to the level of the potential of exposed portions. Accordingly, it is possible to prevent the potential of an isolated non-image dot positioned in between dot images continuously arranged in the main scanning direction, from attenuating to the level of the potential of exposed portions, due to the impact of the potential of the portion of the dot images continuously arranged in the main scanning direction on both sides of the isolated non-image dot. This mitigates gradation loss from occurring in the high density portions in the area gradation, where there are isolated non-image dots positioned in between dot images continuously arranged in the main scanning direction.

Furthermore, when the image carrier is exposed to form dot images continuously arranged in a main scanning direction, each of the latent image potential distributions corresponding to one of the dot images has a short width. Accordingly, it is possible to reduce the impact of the latent image potential of a dot image on the latent image potential of an adjacent dot image in the main scanning direction. This mitigates significant attenuation of the potential on the image carrier where dot images are continuously arranged in the main scanning direction, thus mitigating an increase in the developing potential. Hence, it is possible to mitigate increases in densities of dot images continuously arranged in the main scanning direction.

As a result, densities that are closer to ideal densities can be attained in mid-density portions to high density portions in the area gradation, where there are more dot images continuously arranged in the main scanning direction. Accordingly, area gradation properties can be enhanced.

The present invention is not limited to the specifically disclosed embodiment, and variations and modifications may be made without departing from the scope of the present invention.

The present application is based on Japanese Priority Patent Application No. 2006-206256, filed on Jul. 28, 2006 and Japanese Priority Patent Application No. 2007-034579, filed on Feb. 15, 2007, the entire contents of which are hereby incorporated by reference.

What is claimed is:

1. An image forming apparatus comprising:

an image carrier;

an exposing unit configured to expose a surface of the image carrier with exposure energy based on image data corresponding to dot images to form a latent image; and a developing unit configured to perform a developer contact developing method by applying a developing bias onto a developer carrier carrying a non-magnetic one-component developer and causing the non-magnetic one-component developer on the developer carrier to contact the image carrier, thereby developing the latent image on the image carrier into a toner image, wherein:

the toner image on the image carrier is transferred onto a recording material, either directly or via a surface of an intermediate transfer body; and the developing bias or the exposure energy is adjusted such that an isolated one-dot image has a predetermined image density, the image forming apparatus further comprising:

a control unit configured to control the exposing unit in such a manner that, when the image carrier is exposed to form the dot images continuously arranged in a main scanning direction, a width of a latent image potential distribution in the main scanning direction corresponding to each of the dot images on the image carrier is shorter than that when the image carrier is exposed to form the isolated one-dot image, wherein:

the control unit controls the exposing unit in such a manner that, when the image carrier is exposed to form the dot images continuously arranged in the main scanning direction, an exposure time period for each dot image is shorter than that when the image carrier is exposed to form the isolated one-dot image, and the control unit controls the exposing unit in such a manner that, when the image carrier is exposed to form three or more dot images continuously arranged in the main scanning direction, the exposure time period for a middle dot image positioned in between edge dot images is shorter than that for each of the edge dot images.

2. The image forming apparatus according to claim 1, wherein:

the control unit determines an exposure timing of exposing the image carrier to form each of the dot images continuously arranged in the main scanning direction, wherein the exposure timing is determined such that the dot images continuously arranged in the main scanning direction are bilaterally-symmetric with respect to a center position of all of the dot images.

3. The image forming apparatus according to claim 1, further comprising:

a table of association between numbers of dot images continuously arranged in the main scanning direction, and exposure time periods of exposing the image carrier to form respective ones of dot images, wherein:

the exposure time period is determined according to the table and a number of the dot images continuously arranged in the main scanning direction.

4. The image forming apparatus according to claim 1, further comprising:

a toner density detecting unit configured to detect a toner density of the toner image on the image carrier or on the intermediate transfer body, wherein:

a detection toner image is formed, the toner density of the detection toner image is detected by the toner density detecting unit, and the exposure time period of exposing the image carrier to form each of the dot images continuously arranged in the main scanning direction is determined according to detection results obtained by the toner density detecting unit.

5. The image forming apparatus according to claim 4, further comprising:

a table of association between toner densities, numbers of dot images continuously arranged in the main scanning direction in the toner image, and exposure time periods of exposing the image carrier to form respective ones of dot images, wherein:

the exposure time period of exposing the image carrier to form each of the dot images continuously arranged in the main scanning direction is determined according to the table, the toner density, and the number of dot images continuously arranged in the main scanning direction in the toner image.

6. The image forming apparatus according to claim 1, wherein:

the image carrier is exposed to form the isolated one-dot image with full exposure.

7. The image forming apparatus according to claim 1, wherein:

the exposure time period of exposing the image carrier to form each of the dot images continuously arranged in the main scanning direction is determined according to a number of the dot images continuously arranged in the main scanning direction and a number of dot images surrounding the dot images continuously arranged in the main scanning direction.

8. The image forming apparatus according to claim 1, wherein:

the control unit controls the exposing unit in such a manner that, when the image carrier is exposed to form the dot images continuously arranged in the main scanning direction, the exposure energy for each dot image is lower than that when the image carrier is exposed to form the isolated one-dot image.

9. The image forming apparatus according to claim 8, wherein:

the control unit controls the exposure energy to be different according to a number of dot images continuously arranged in the main scanning direction.

10. The image forming apparatus according to claim 8, further comprising:

a table of association between numbers of dot images continuously arranged in the main scanning direction, and exposure energy for exposing the image carrier to form respective ones of dot images, wherein:

the exposure energy is determined according to the table and a number of the dot images continuously arranged in the main scanning direction.

11. The image forming apparatus according to claim 8, further comprising:

a toner density detecting unit configured to detect a toner density of the toner image on the image carrier or on the intermediate transfer body, wherein:

a detection toner image is formed, the toner density of the detection toner image is detected by the toner density detecting unit, and the exposure energy for exposing the image carrier to form each of the dot images continuously arranged in the main scanning direction is determined according to detection results obtained by the toner density detecting unit.

12. The image forming apparatus according to claim 11, further comprising:

a table of association between toner densities, numbers of dot images continuously arranged in the main scanning direction in the toner image, and exposure energy for exposing the image carrier to form respective ones of dot images, wherein:

the exposure energy for exposing the image carrier to form each of the dot images continuously arranged in the main scanning direction is determined according to the table, the toner density, and the number of dot images continuously arranged in the main scanning direction in the toner image.

13. The image forming apparatus according to claim 8, wherein:

the exposure energy for exposing the image carrier to form each of the dot images continuously arranged in the main scanning direction is determined according to a number of the dot images continuously arranged in the main scanning direction and a number of dot images surrounding the dot images continuously arranged in the main scanning direction.

14. An image forming method comprising the steps of:

forming a latent image on a surface of an image carrier by exposing the surface of the image carrier based on input image data corresponding to dot images; and developing the latent image on the image carrier by performing a developer contact developing method with the use of a non-magnetic one-component developer, wherein:

when the image carrier is exposed to form the dot images continuously arranged in a main scanning direction, a width of a latent image potential distribution in the main scanning direction corresponding to each of the dot images on the image carrier is shorter than that when the image carrier is exposed to form the isolated one-dot image when the image carrier is exposed to form three or more dot images continuously arranged in the main scanning direction, the exposure time period for a middle dot image positioned in between edge dot images is shorter than that for each of the edge dot images.

15. The image forming method according to claim 14, wherein:

when the image carrier is exposed to form the dot images continuously arranged in a main scanning direction, a width of a latent image potential distribution in the main scanning direction corresponding to each of the dot images on the image carrier is shorter than that when the image carrier is exposed to form the isolated one-dot image, and when the image carrier is exposed to form the dot images continuously arranged in the main scanning direction, an exposure time period for each dot image is shorter than that when the image carrier is exposed to form the isolated one-dot image.

16. The image forming method according to claim 14, wherein:

when the image carrier is exposed to form the dot images continuously arranged in a main scanning direction, a width of a latent image potential distribution in the main scanning direction corresponding to each of the dot images on the image carrier is shorter than that when the image carrier is exposed to form the isolated one-dot image, and when the image carrier is exposed to form the dot images continuously arranged in the main scanning direction, the exposure energy for each dot image is lower than that when the image carrier is exposed to form the isolated one-dot image.

17. An image forming method, comprising:

forming a latent image on a surface of an image carrier by exposing the surface of the image carrier based on input image data corresponding to dot images including determining an exposure timing of exposing the image carrier to form each of the dot images continuously arranged in the main scanning direction, wherein the exposure timing is determined such that the dot images continuously arranged in the main scanning direction are bilaterally-symmetric with respect to a center position of all of the dot images; and developing the latent image on the image carrier by performing a developer contact developing method with the use of a non-magnetic one-component developer.

* * * * *